US007258960B2

(12) United States Patent
Ohira et al.

(10) Patent No.: US 7,258,960 B2
(45) Date of Patent: Aug. 21, 2007

(54) PRODUCTION APPARATUS OF TONER FOR DEVELOPING ELECTROSTATIC IMAGES, PRODUCTION METHOD THEREOF, AND TONER FOR DEVELOPING ELECTROSTATIC IMAGES

(75) Inventors: Akira Ohira, Hachioji (JP); Masafumi Uchida, Hachioji (JP); Yoshiki Nishimori, Hachioji (JP); Shoichiro Ishibashi, Hachioji (JP)

(73) Assignee: Konica Corporation (JP)

( * ) Notice: Subject to any disclaimer, the term of this patent is extended or adjusted under 35 U.S.C. 154(b) by 176 days.

(21) Appl. No.: 10/392,669

(22) Filed: Mar. 18, 2003

(65) Prior Publication Data

US 2003/0194629 A1 Oct. 16, 2003

(30) Foreign Application Priority Data

Mar. 26, 2002 (JP) ..... 2002-085389

(51) Int. Cl.
*G03G 9/08* (2006.01)

(52) U.S. Cl. ..... 430/137.1; 430/137.14

(58) Field of Classification Search ..... 430/137.1, 430/137.14, 137.17
See application file for complete search history.

(56) References Cited

U.S. PATENT DOCUMENTS

| | | | | |
|---|---|---|---|---|
| 5,364,335 | A * | 11/1994 | Franzen et al. | 494/15 |
| 6,177,223 | B1 * | 1/2001 | Hashimoto et al. | 430/126 |
| 6,203,957 | B1 * | 3/2001 | Nomura et al. | 430/110.4 |
| 2003/0129519 | A1 * | 7/2003 | Ishibashi et al. | 430/137.14 |

* cited by examiner

*Primary Examiner*—Janis L. Dote
(74) *Attorney, Agent, or Firm*—Squire, Sanders & Dempsey L.L.P.

(57) ABSTRACT

An apparatus for producing toner for developing an electrostatic latent image, is provided with an inlet section to receive a slurry containing toner particles, impure fine particles having a specific gravity smaller than that of the toner particles and aqueous medium; a centrifugal concentrating device for applying centrifugal force to the slurry and having a precipitating plate with which the toner particles are precipitated from the slurry and an accommodating section to accommodate a concentrated slurry containing the precipitated toner particles, and an outlet section to deliver impure fine particles and aqueous medium.

6 Claims, 5 Drawing Sheets

FIG. 5 ( a )
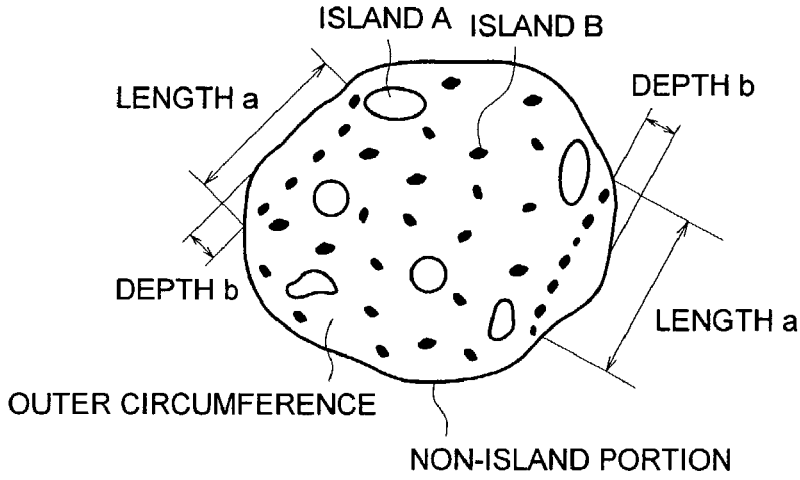
FIG. 5 ( b )
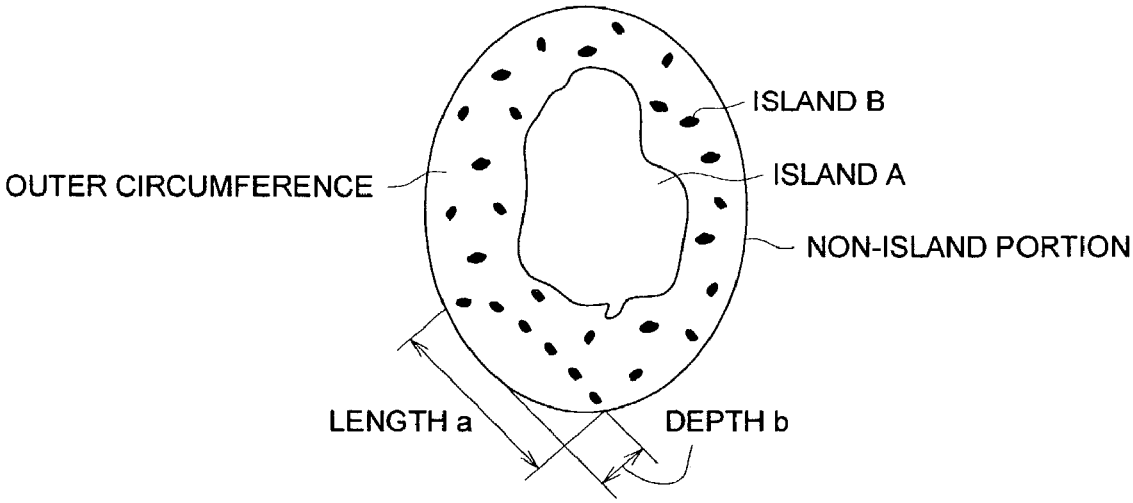

PRODUCTION APPARATUS OF TONER FOR DEVELOPING ELECTROSTATIC IMAGES, PRODUCTION METHOD THEREOF, AND TONER FOR DEVELOPING ELECTROSTATIC IMAGES

BACKGROUND OF THE INVENTION

This invention relates to a production method and production apparatus of a toner for developing electrostatic images. To state it in more detail, this invention relates to a production method and a production apparatus of a toner for developing electrostatic images wherein toner particles are obtained through a process of practicing the removal of impurities attached to the surface of toner particles by the concentration of the slurry composed of particles produced at the time of toner particle production, and to a toner for developing electrostatic latent images obtained by said production method.

In recent years, it is disclosed in the publication of the unexamined patent application 2000-214629 that, as regards a toner obtained by a polymerization process based on a suspension polymerization method or an emulsion polymerization method, because the particle diameter and shape can be controlled during polymerization process in an aqueous medium, it can be obtained a toner composed of toner particles having a small size, a uniform size distribution, and a round shape with no protrusion on the particles; because of its reproducibility of fine lines and a high resolution, it is remarked as a toner capable of reproducing small dots for a digital image.

As described in the above, as regards a polymerization toner, toner particles are produced by a polymerization process in an aqueous medium, and from particles produced in a slurry state, toner particles dispersed in an aqueous medium are obtained. In order to extract the produced toner particles from the aqueous medium, slurry concentration for removing water from the aqueous medium in a slurry state containing particles is repeated. In the aqueous medium which is a dispersion medium of the slurry of dispersed particles, impurities such as free releasing agent particles and particles of their decomposition products leaving from the surface of the toner particles are contained. Therefore, because these impurities are adhering on the surface of the toner particles separated from the aqueous medium, it is necessary that the toner particles after separation are well washed to remove these impurities from the surface of the toner particles.

In the publication of the unexamined patent application 2000-292976, it is disclosed a technology relating to a toner production method wherein washing of toner particles is practiced with supply of water until the electrical conductivity of the filtered liquid becomes under a specified value while slurry concentration by centrifugal separation is being carried out. Further, in the publication of the unexamined patent application 2001-249490, it is disclosed that the following operation is repeated plural times: that is, slurry containing toner particles is stirred in a container equipped with a stirring plane and a filter material with a washing liquid added, and the slurry is made to pass the filter material under the application of a pressure to remove the washing liquid.

However, according to these technologies, in the slurry concentration process, only it is practiced that, with a filter cloth sheet or a filter material provided in a centrifugal separation apparatus and a stirring container at the time the slurry concentration is carried out, a filtration operation using a filter material is repeated.

Further, the inventors of the present invention newly found that a toner obtained through a process of slurry concentration disclosed in the publication of the unexamined patent application 2000-292976 had its charging ability brought into a varied state after it had been subjected to a continuously repeated copying process exceeding one hundred thousand times, and it was very difficult to provide a stable toner which is not subject to the change in the charging ability in a mass continuous copying over one hundred thousand sheets accordingly. Further, this tendency was more strengthened in the case where an image formation over a long period of time in a high-temperature high-humidity environment was carried out, and poor charging, toner fusing to component parts, and generation of contamination were remarkably presented. In the latest days, there are image forming apparatus which carry out supply of documents through outputting a mass of documents having a number of pages and binding them to have a shape of a booklet, and it is no more a rare thing in the uses of users to practice a continuous copying operation reaching hundreds of thousands of sheets or millions of sheets.

Further, it is inferred that the above-mentioned change in the charging ability generated in a mass continuous copying process exceeding one hundred thousand sheets is perhaps due to the removal of impurities being insufficiently made from the surface of toner particles for a toner having been subjected to slurry concentration using a filter material. That is, it is inferred that the impurities, which are released from toner particles at the time the concentrated slurry is again dispersed to wash the toner particles after the slurry concentration is carried out, are drifting like floating objects in the liquid, and therefore, when the second slurry concentration after washing is carried out, the impurities drifting in the liquid as floating objects are trapped in the toner layer formed on the filter material, and remain on the toner particle surface having been subjected to the final washing and drying.

Hence, as regards a toner obtained through a process of slurry concentration using a filter material, impurities are easily trapped again on the surface of toner particles; however, for a conventional centrifugal separation means, a filter material has been essential and indispensable in order to capture particles with certainty at the time of concentration.

Further, the average particle diameter of a polymerization toner is smaller than 10 μm, and in order to cope with the reproducibility of fine lines of a digital image forming apparatus in recent days, it is further advanced to make particle size smaller. However, it has been known that the concentration of slurry composed of small-sized particles having a particle diameter smaller than 10 μm using a conventional centrifugal means or a decantation means was very difficult for the reasons of the performance of the apparatus etc.

Further, as regards a conventional centrifugal separation apparatus, it is known that owing to the load by the centrifugal force at the time of slurry concentration, a degradation of toner property such that breakage of toner particles and their becoming fragile are brought about or the uniformity of the orientation of polar radials on the surface of toner particles is destroyed is brought about; therefore, in a conventional centrifugal separation apparatus, the operation is carried out with the centrifugal force at the time of slurry concentration suppressed as much as possible. However, because of the centrifugal force being made small, the lowering of productivity is inevitable, and on top of it, the degradation of the toner property cannot be avoided even though the centrifugal force is made small; thus, although the stabilization of the quality of a toner based on slurry concentration has been an important problem to be solved urgently, it has been unable at all to find the clue to the solution of it.

SUMMARY OF THE INVENTION

This invention was made on the basis of the above-mentioned situation, and it is the first object of this invention to provide a toner for developing electrostatic images which keeps a stable charging ability with out producing a problem of toner filming on the photoreceptor and poor cleaning even through a continuous image formation in a high-temperature high-humidity environment or over a long period of time not less than hundreds of thousands of sheets by the use of a sturdy toner that is immune to the influence at the time of slurry concentration and has the orientation of the polar radicals on the surface of the toner particles not destroyed, while providing a production apparatus and a production method to make it possible to obtain such a toner.

It is the second object of this invention to provide a toner for developing electrostatic images which makes it possible to obtain a high-quality image having no background density and no toner scattering owing to the toner particles having no impurities such as a free releasing agent remaining left on the particle surface even through an image formation in a high-temperature high-humidity environment, and does not give a contamination by the toner to the photoreceptor and the triboelectric charging member, while providing a production apparatus and a production method to make it possible to obtain such a toner.

It is the third object of this invention to provide a production apparatus and a production method to make it possible to obtain a stable toner for developing electrostatic images which has the orientation of the polar radicals on the surface of toner particles kept undestroyed and has no impurities remaining left on the particle surface at all.

Further, it is the fourth object of this invention to provide a production apparatus and a production method to make it possible to obtain a toner for developing electrostatic latent images having a stable property without the use of a filter material in the slurry concentration process.

Moreover, it is the fifth object of this invention to provide a production apparatus and a production method to make it possible to obtain toner particles for developing electrostatic images which are not influenced by the centrifugal force acting at the time of slurry concentration.

After diligent investigations and experiments repeated day after day, the inventors remarked the specific weight of the impurities adhering to toner particles is very close to the specific weight of water. As the result, the inventors found that the impurities could be removed from the particle surface even if the precipitation distance of the particles in the centrifugal separation apparatus used in slurry concentration was very short. Further, the inventors made it possible, after repeating further energetic investigations, to produce a toner for developing electrostatic images having its charging ability not changed and a stable property even through the use in a continuous image formation in a high-temperature high-humidity environment, by making it possible to carry out dehydration from the slurry and the concentration in a moment by means of a centrifugal separation apparatus having at least one or more precipitating plates and its precipitation distance made very short, and by making it possible to carry out with certainty the releasing of impurities adhering to the particle surface from it without destroying the stable orientation of the polar radicals on the surface of toner particles.

As the result, the inventors found that the prevention of the re-trapping of impurities on the surface of toner particles was made possible by the practice of slurry concentration without the use of a filter material, thus the obtained toner particles had the charging ability not changed even through continuous copying over one million sheets, and a high-quality image having no contamination by the toner could be obtained without the generation of toner filming on the photoreceptor and poor cleaning.

That is, the above-mentioned objects of this invention can be accomplished by any one of the structures described below.

[1] A toner production apparatus of a toner for developing electrostatic images which is brought in a slurry state after particle formation in an aqueous medium in its production process, having a concentration means for carrying out the concentration of said slurry by the centrifugal precipitation of the particles contained in said slurry, characterized by said concentration means comprising a containing part for containing said slurry, and at least one or more precipitating plates in said containing part.

[2] A toner production apparatus of a toner for developing electrostatic images as set forth in the above-mentioned structure [1], characterized by the aforesaid containing part being able to be opened and closed through a junction part, and comprising a discharging means for discharging concentrated slurry from said junction part.

[3] A toner production apparatus of a toner for developing electrostatic images as set forth in the above-mentioned structure [1], characterized by the aforesaid precipitating plates being arranged in such a way as to have a shape of a circular cone in the aforesaid containing part.

[4] A toner production apparatus of a toner for developing electrostatic images as set forth in the above-mentioned structure [3], characterized by the aforesaid precipitating plates being arranged in such a way as to have a shape of a circular cone opening downward.

[5] A toner production apparatus of a toner for developing electrostatic images as set forth in any one of the above-mentioned structures [1], [3], and [4] characterized by the aforesaid precipitating plates being plural and arranged at intervals of 0.5 mm to 1.0 mm.

[6] A toner production apparatus of a toner for developing electrostatic images as set forth in any one of the above-mentioned structures [1] to [5], characterized by a separation precipitation area formed by the aforesaid precipitating plates being not smaller than 10 times of the setup area of the aforesaid concentration means.

[7] A toner production method of a toner for developing electrostatic images which is brought in a slurry state after particle formation in an aqueous medium in its production process, characterized by it that in said production method, by means of a centrifugal precipitating apparatus comprising at least one or more precipitating plates, while the concentration of said slurry is being carried out through the centrifugal precipitation of particles contained in said slurry, said concentrated slurry is automatically discharged out of said centrifugal precipitating apparatus.

[8] A toner production method of a toner for developing electrostatic images as set forth in the above-mentioned structure [7], characterized by the pH of the aforesaid slurry being not smaller than 2 and not greater than 6.5.

[9] A toner production method of a toner for developing electrostatic images as set forth in the above-mentioned structure [7], characterized by the pH of the aforesaid slurry being not smaller than 8 and not greater than 12.

[10] A toner production method of a toner for developing electrostatic images as set forth in any one of the above-mentioned structures [7] to [9], characterized by the automatic discharge time at the time the aforesaid concentrated slurry is automatically discharged out of the aforesaid centrifugal precipitating apparatus being not longer than 1 second per 1 liter of said concentrated slurry.

[11] A toner production method of a toner for developing electrostatic images as set forth in any one of the above-mentioned structures [7] to [10], characterized by the repeating of the process that the aforesaid concentrated slurry having been automatically discharged is diluted in an aqueous medium, the diluted slurry is again concentrated by the centrifugal precipitating apparatus, and the concentrated slurry is automatically discharged.

[12] A toner production method of a toner for developing electrostatic images as set forth in any one of the above-mentioned structures [7] to [11], characterized by the particle concentration in the slurry subjected to the concentration by means of the aforesaid centrifugal precipitating apparatus being 8% to 40% by weight.

[13] A toner for developing electrostatic images which is obtained by the practice of particle formation in an aqueous medium and is produced by a production method as set forth in any one of the above-mentioned structures [7] to [12], characterized by the number of toner particles holding free releasing agent particles contained in said toner being not greater than 3 per 100 toner particles.

[14] A toner for developing electrostatic images as set forth in the above-mentioned structure [14], characterized by the aforesaid particles formed in an aqueous medium having a sea-island structure.

[15] A toner for developing electrostatic images as set forth in the above-mentioned structure [13] or [14], characterized by the value of the average particle diameter of the aforesaid particles formed in an aqueous medium being not smaller than 3 μm and not greater than 9 μm.

A production apparatus of a toner for developing electrostatic images according to this invention comprises at least the following means; namely, means for carrying out the agglomeration of resin particles in an aqueous medium to carry out particle formation, a concentration means for condensing the slurry containing the formed particles, and a drying means for drying the toner particles separated from the concentrated slurry. The concrete content of each means will be described later in the description concerning the production method.

A concentration means according to this invention is representatively a centrifugal precipitating apparatus of a disk type as will be described later; this comprises a containing part having a shape of a bowl made up of two members laid one upon another. In this invention, the containing part in a centrifugal precipitating apparatus is also called the main body. Slurry to be subjected to concentration is contained in this bowl-shaped containing part. The containing part is directly connected to a rotor capable of high-speed rotation, and the concentration of slurry is done by the rotation of the rotor. In this invention, the inside of the containing part is also called a concentration room, and in the concentration room, precipitating plates centering on the axial center of the rotary shaft of the above-mentioned rotor are arranged in such a way as to form a conical frustum. Further, the meeting part of the two members making up the containing part has a junction portion capable of being opened and closed.

A precipitating plate according to this invention is a member having a shape of a plate for capturing particles which are separated from the slurry and precipitate by the action of the centrifugal force caused by the rotation of the centrifugal precipitating apparatus. The precipitating plates are arranged in the concentration room, and have a shape of a circular frustum opening downward centering on the axial center of the rotary shaft of the rotor.

The total area of precipitating plates according to this invention represents the total sum of the areas of all the precipitating plates arranged in the above-mentioned concentration room. In this invention, the total area of precipitating plates is also called the separation precipitation area.

A centrifugal precipitating apparatus according to this invention is an apparatus for carrying out slurry concentration through the separation precipitation of the particles by the action of a centrifugal force from the slurry, which has a concentration of 8% to 40% by weight of the particles obtained by the practice of particle formation in an aqueous medium and is put into the apparatus, and removing impurities adhering on the surface of particles.

Slurry concentration according to this invention means an operation of not only increasing the particle concentration in the slurry by the removal of the dispersion medium from the dispersion liquid (slurry) containing the particles formed in an aqueous medium, but also forming clean particles having no impurities attached by the removal of impurities attached to the surface of particles.

A concentration method of slurry in a production method of a toner for developing electrostatic images according to this invention is a method for carrying out slurry concentration in which particles in the slurry are subjected to centrifugal precipitation by the use of an apparatus called a centrifugal precipitating apparatus of a disk type to become separated from the dispersion medium. For the centrifugal precipitating apparatus for carrying out slurry concentration according to this invention, a centrifugal precipitating apparatus of a disk type is representative. A centrifugal precipitating apparatus of a disk type is one having a plurality of disk-shaped precipitating plates arranged at short intervals over the rotary shaft of the rotor for making a centrifugal force act on the slurry at the time of concentration, and it was found that the object of this invention could be accomplished by the practice of slurry concentration by means of this apparatus.

A centrifugal precipitating apparatus of a disk type does not use a filter material at the time of slurry concentration; therefore, it is apparently different from the above-mentioned conventional slurry concentration means for which the use of a filter material is essential. That is, because a filter material is not used at the time of slurry concentration in this invention, it is not formed a toner particle layer, which has been formed on the filter material as done in the slurry concentration by a conventional centrifugal separation apparatus; therefore, re-trapping of impurities onto the surface of toner particles at the time of slurry concentration is not generated.

Further, in this invention, because a filter material is not used at the time of slurry concentration, it is possible to practice a slurry concentration operation continuously. In conventional slurry concentration, slurry concentration based on a batch method has been general for the purpose of using the filter material stably. Further, a slurry concentration method of a continuous type using a filter material has been also proposed, but because it became a bottleneck to keep the filter material in a stable state for the continuous processing of a large amount of slurry, excessive setup space and a great investment was required, and the actualization has been almost impossible.

A centrifugal precipitating apparatus of a disk type to be used in slurry concentration according to this invention makes a continuous processing possible even for a large amount of slurry which has to be coped with by batch processing in a conventional technology. That is, by the application of a centrifugal force of 5000 G to 15000 G to the slurry introduced into the apparatus, concentration is in a moment finished, and the concentrated slurry obtained is automatically discharged continuously out of the apparatus. In this way, concentrated slurry having been obtained by a centrifugal precipitating apparatus of a disk type used in this invention is not kept under the influence of a centrifugal force over a long period of time in the centrifugal precipitating apparatus as heretofore; therefore, the obtained toner particles have the uniformity of charging ability on the surface of the particles not disturbed, and the problem that the particles are broken and fragile particles are produced is solved.

BRIEF DESCRIPTION OF THE DRAWINGS

FIGS. 5(*a*) and 5(*b*) each is a schematic drawing showing examples of the particle structure of a toner particle produced in this invention.

DETAILED DESCRIPTION OF THE PREFERRED EMBODIMENT

A centrifugal precipitating apparatus of a disk type to be used desirably as a concentration means according to this invention makes toner particles in slurry in a moment precipitate by the action of a centrifugal force to carry out slurry concentration, and at the same time, automatically discharges the concentrated slurry out of the apparatus.

It has already been stated that the idea of this invention was found by the inventors remaking the difference in the specific weight between the toner particles and the impurities in the slurry. That is, the inventors remarked that the specific weight of the impurities composed of free releasing agent particles etc. remaining on the surface of particles is not so much different from the specific weight of water, and found that it is possible to remove the impurities from the surface of particles with certainty even with the precipitation distance of particles made shorter by a large margin on the premise of the difference in the specific weight between the both.

Figure 1:
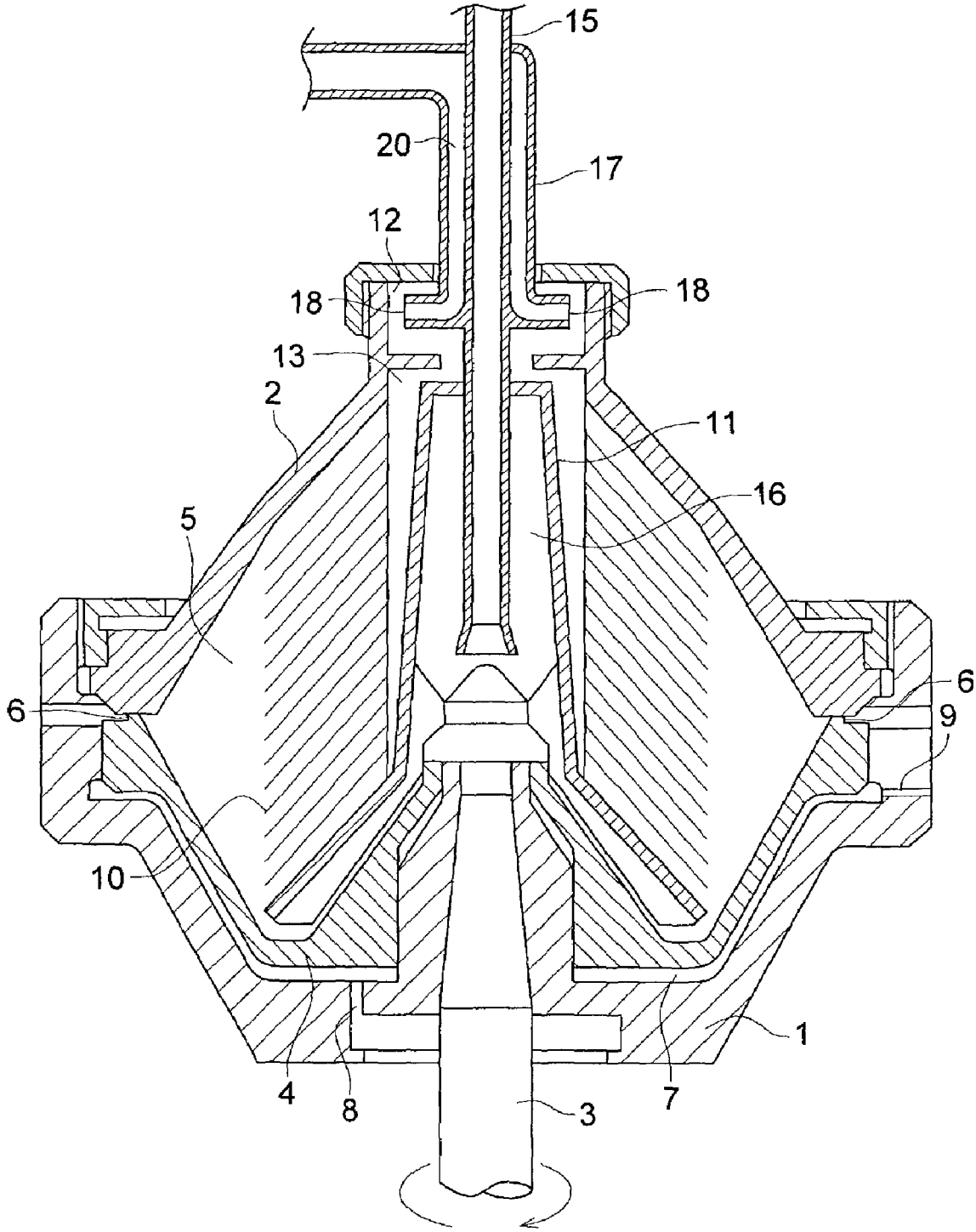
FIG. 1 is a structural drawing of a cross-section of a centrifugal precipitating apparatus of a disk type to be desirably used in this invention.

FIG. 1 shows an example of a centrifugal precipitating apparatus of a disk type to be desirably used in this invention, and is a cross-sectional view of the main body of said apparatus at a plane containing its axis.

The main body of the centrifugal precipitating apparatus 1 has a rotor 3 at the center, and is made to become a one united body, coupled to this rotor in the axial direction with a gripping ring. The main body 1 consists of an upper member 2 and a lower member 4 as two bowls with one laid upon another upside down, and in the inside, there is provided a concentration room 5 with precipitating plates to be described later arranged therein. Further, from the junction portion 6 of the upper member 2 and the lower member 4, slurry concentrated in the concentration room is automatically discharged out of the apparatus.

A centrifugal precipitating apparatus of a disk type to be used in this invention is capable of separating solid particles so long as there is a difference in the specific weight of the particles not less than 2%, and for the difference in the specific weight between the toner particles according to this invention and the impurities, it is possible to remove the impurities from the particles in an extremely short precipitation distance. That is, a centrifugal precipitating apparatus of a disk type to be used in this invention, as shown in FIG. 1, has cone-shaped precipitating plates 10 arranged around the rotor located at the center of the apparatus in such a way as to form a shape of coarse oil-paper umbrellas placed one over another at intervals of 0.5 mm to 1 mm. That is, it is found that, in this invention, because the specific weight of the impurities to be removed from the surface of particles has approximately the same value as the specific weight of water, it is possible to arrange the precipitating plates with such an extremely short precipitation distance, and concentrated slurry can be obtained with the impurities removed from on the surface of particles with certainty. Besides, it is possible to remove the impurities with certainty so long as there is a difference in the specific weight not smaller than 2% in a centrifugal precipitating apparatus to be used in this invention, but it is necessary to change the precipitation distance in accordance with the specific weight difference.

A centrifugal precipitating apparatus of a disk type to be used in this invention makes it possible to remove the impurities in a moment from the surface of toner particles to obtain concentrated slurry, by the change of natural precipitation caused-by gravity into a force exceeding 5000 to 15000 times of gravity caused by a centrifugal force, in other words, by the application of a centrifugal force of 5000 G to 15000 G.

By an experiment concerning the processing capability of a centrifugal precipitating apparatus of a disk type to be used in this invention, it was found that the time required for the completion of concentration of one liter of slurry by a batch method was not longer than 1 second. Further, in this invention, because the centrifugal precipitating apparatus of a disk type can automatically discharge concentrated slurry having the impurities removed from the junction portion 6, it can automatically discharge the concentrated slurry out of the concentration room 5 concurrently while it is carrying out slurry concentration; therefore, the improvement of productivity and operation efficiency by a large margin is accomplished, and because the concentrated slurry is never subjected to the influence of a centrifugal force of 5000 G to 15000 G for a long time, toner particles is not given a load caused by the influence of the centrifugal force. As the result, a sturdy toner having no disturbance of the orientation of polar radicals on the particle surface, no mechanical fragility, and an excellent charging ability can be obtained.

Further, it was found that, in this invention, the separation of impurities from toner particles having a specific weight difference of about 0.1 from the impurities was possible with the intervals of the precipitating plates of the centrifugal precipitating apparatus of a disk type made to be 0.5 mm. It was confirmed that the intervals of the precipitating plates, which corresponds to the precipitation distance of the particles, was desirably 0.5 mm to 10 mm, and was more desirably 0.75 mm to 1 mm.

A centrifugal precipitating apparatus of a disk type to be used in this invention has cone-shaped precipitating plates arranged around the rotary shaft as described in the above; as shown in FIG. 1, by the arrangement of a number of the thin plate-shaped precipitating plates 10 in a state of tilt to form circular cones opening downward stacked one over another at intervals, to have a form looking as if coarse oil-paper umbrellas were stacked opening downward one over another, it is possible to have a separation precipitation area, for example, not less than 10 times of the setup area of the centrifugal precipitating apparatus as a concentration means, and on top of an enhancement of the efficiency of the operation space, a large-quantity, high-speed separation becomes possible. Besides, in this invention, it is possible to obtain a separation precipitation area not smaller than 10 times of the setup area of the concentration means.

In the slurry concentration by means of a centrifugal precipitating apparatus of a disk type to be used in this invention, the volume ratio of solid particle component (hereinafter also referred to as the particle concentration) in the slurry to be subjected to concentration is 2% to 85%, desirably 5% to 60%, and more desirably 8% to 40%. Further, it is appropriate that the particle size is not smaller than 0.1 μm. The particle concentration of slurry to be subjected to concentration includes, for example, the concentration of the slurry to be obtained immediately after the particle formation in an aqueous medium, and on top of it, that of the slurry to be obtained through the collection and putting into washing water for the concentrated slurry which has been subjected to slurry concentration and automatically discharged out of the centrifugal precipitating apparatus. Besides, to state it for comparison, in a method using a conventional centrifugal precipitating apparatus or decanter, it has been desirable to make the volume ratio of solid particle component 5% to 60%, and the particle size not smaller than 10 μm; therefore, the removal of impurities from the surface of such toner particles having a particle size smaller than 10 μm as toner particles to be obtained by a polymerization method was accompanied by a very great difficulty. By this invention, it was improved by leaps and bounds to remove the impurities from the surface of toner particles having an average particle size of 3 μm to 9 μm to be obtained by particle formation in an aqueous medium by means of a centrifugal precipitating apparatus of a disk type having the above-mentioned performance.

As described in the above, in a centrifugal precipitating apparatus of a disk type 1 to be desirably used in this invention, by the arrangement of a number of precipitating plates made up of thin plates for making slurry concentration put in a state of tilt at short intervals of 0.5 mm to 1.0 mm, it is possible to carry out rapidly in a continuous flow the concentration of slurry in large quantities composed of particles for which the particle formation has been completed in an aqueous medium, and the removal of impurities from the surface of particles.

Figure 2:
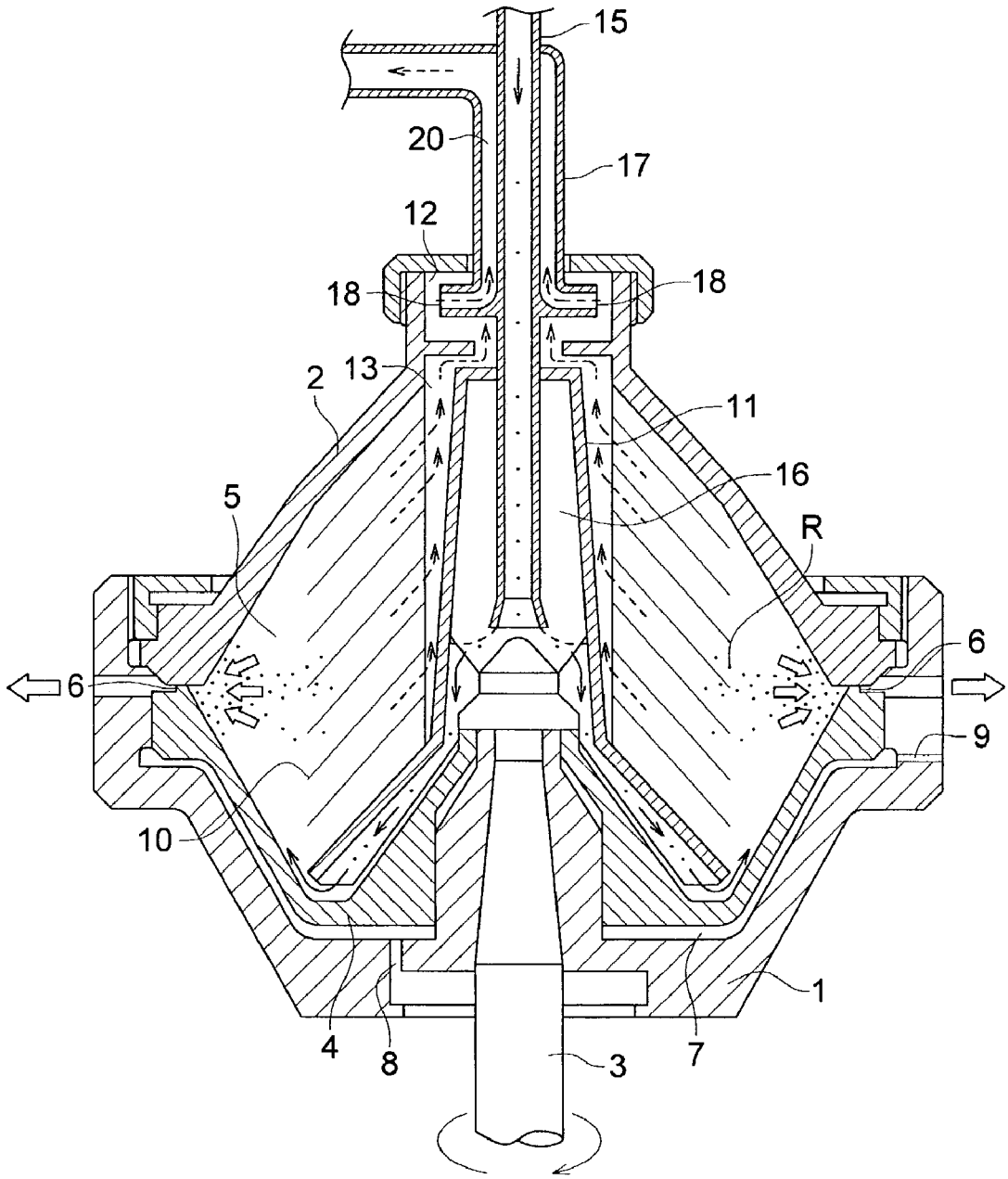
FIG. 2 is a drawing showing the movement of particles in slurry and a dispersion medium containing impurities in a centrifugal precipitating apparatus of a disk type to be used in this invention.

Next, slurry concentration by means of a centrifugal precipitating apparatus of a disk type to be desirably used in this invention will be explained. FIG. 2 is a drawing showing the movement of particles in slurry and a dispersion medium containing impurities in the main body of the apparatus shown in FIG. 1. The solid black circles in the drawing represent toner particles R, and the solid directed lines, the void arrow marks, and broken directed lines in the drawing represent the flow of the slurry before concentration, the flow of the particles, and the flow of the liquid after concentration respectively. In addition, in FIG. 2, it is omitted to show impurity particles in the drawing. As shown in FIG. 2, in a centrifugal precipitating apparatus of a disk type to be desirably used in this invention, by the action of a centrifugal force of 5000 G to 15000 G, the particles move in the upper part of the space between the neighboring precipitating plates 10 towards the direction of the centrifugal force and are accumulated in the peripheral part of the concentration room 5. At this time, the impurity particles adhering to the surface of toner particles are removed from the surface of particles as if bran and rice powder being present on the surface of rice grains were ground off the rice grain surface during the washing of rice for cooking. Further, the liquid containing impurity particles moves to the central part of the apparatus through the lower part of the space between the neighboring precipitating plates. Because the impurity particles composed of free releasing agent particles etc. have a specific weight approximately equal to the specific weight of the dispersion liquid, they move to the central part of the apparatus together with the dispersion liquid; thus, the impurity particles are completely detached off the toner particles.

As described in the foregoing, by means of a centrifugal precipitating apparatus of a disk type to be desirably used in this invention, the concentrated slurry accumulated in the peripheral part of the concentration room 5, as shown in FIG. 3(B), is automatically discharged in a moment out of the concentration room 5 when the junction portion 6 located at the border between the upper member 2 and the lower member 4 making up the apparatus main body 1 is opened by an order of several millimeters. In this way, the concentrated slurry is automatically discharged out of the apparatus main body 1; thus, the discharging and collection of the concentrated slurry to the outside can be done without the use of a filter material.

In a centrifugal precipitating apparatus of a disk type to be desirably used in this invention, it is possible to carry out continuously a series of operations such that, while slurry having particles formed in an aqueous medium is made to move through continuously by the apparatus, the removal of impurities from the surface of particles and the slurry concentration are carried out, and further the concentrated slurry obtained is automatically discharged out of the concentration room 5 by the action of a centrifugal force.

Besides, in a centrifugal precipitating apparatus of a disk type to be desirably used in this invention, it is desirable from the viewpoint of production efficiency that the concentrated slurry, having been automatically discharged out of the concentration room 5, is accumulated in an accumulation space (not shown in the drawing) provided at the outer peripheral part of the apparatus main body 1 and collected.

Figure 3:
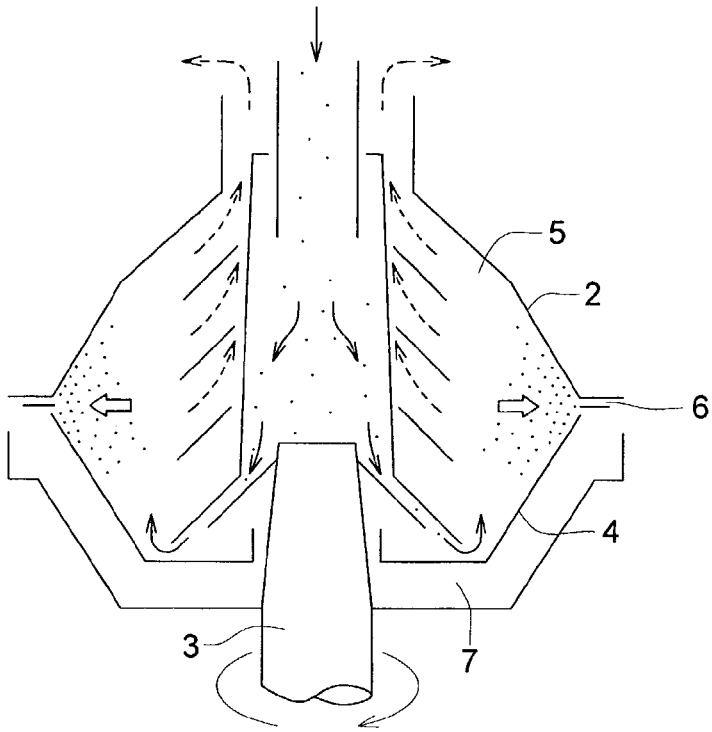
FIG. 3(*a*) and FIG. 3(*b*) each is a drawing showing the automatic discharging caused by the opening and closing of the junction portion of a centrifugal precipitating apparatus of a disk type to be used in this invention.
Figure 3:
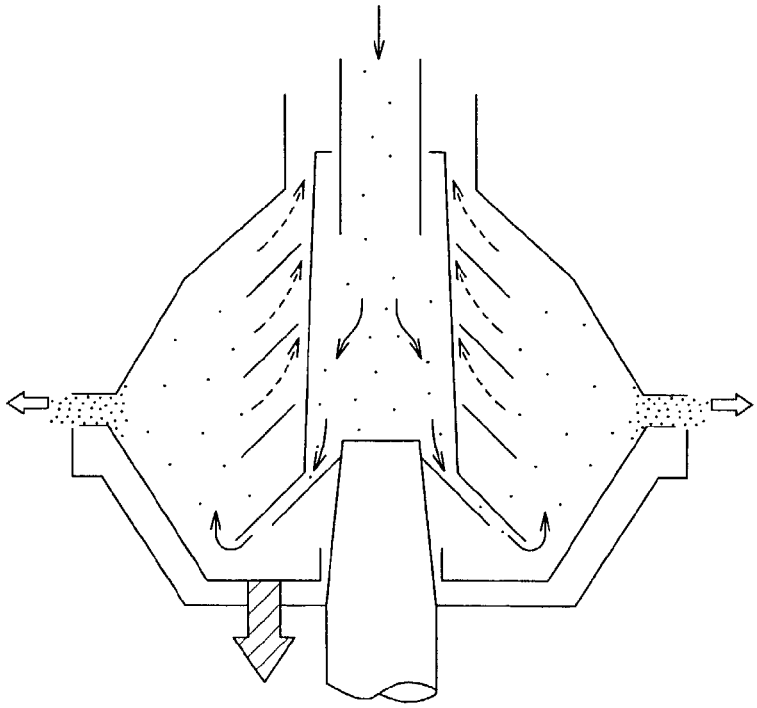

The opening and closing of the junction portion 6 of the main body 1 of a centrifugal precipitating apparatus of a disk type to be desirably used in this invention is made by a vertical movement of the lower member 4 to make up the apparatus main body 1. FIG. 3 is a schematic drawing showing the opening and closing of the junction portion 6 of the apparatus main body 1; FIG. 3(A) shows the junction portion 6 at the time of no discharging when it is closed, and FIG. 3(B) shows the junction portion 6 at the time of automatic discharging when it is opened. Besides, the directed solid lines, the void arrow marks, the directed broken lines, and further the arrow mark with hatching in the drawing represent the flow of the slurry before concentration, the flow of the particles, the flow of the liquid after concentration, and the direction of the movement of the lower member 4 respectively. The vertical movement of the lower member 4 is caused by the filling of a lower member operation room (also called a blockade room) shown by the sign 7 in FIG. 1 with high-pressure water, and as shown in FIG. 3(A), by the actualization of a state of pressing the lower member 4 strongly to the upper member 2 to form a close contact state of both the members, the junction portion 6 is closed.

Further, by the removal of the high-pressure water filling the lower member operation room, the lower member 4 is moved downward to open the junction portion 6. During the open period, a clearance of an order of several millimeters is formed between the lower member 4 and the upper member 2 as described in the above, and the concentrated slurry accumulated in the peripheral part of the concentration room 5 by the action of the centrifugal force caused by the rotation of the rotor 3 is forcibly discharged in a moment out of the concentration room 5. Only such an extremely short period of time is required for the opening of the junction portion 6 owing to the effective utilization of the centrifugal force caused by the rotation of the rotor 3.

The control of the opening and closing of the junction portion 6 is made by the control of the supply and discharge of high-pressure water to and from the lower member operation room 7 actuated by the reception of a signal from a sensing device such as a timer trigger or a self trigger (not shown in the drawing). As regards the sensing device for carrying out the control to open and close the junction portion 6, in the case where the amount of the concentrated slurry at the time of automatic discharging to be done per unit time is approximately constant and does not fluctuate, because the accumulation rate of the concentrated slurry in the concentration room 5 is constant, it is desirable a control of opening and closing by means of a trigger timer to carry out an automatic discharging at time intervals set beforehand.

Further, in the case where there is fluctuation in the amount of concentrated slurry accumulated per unit time, because the accumulation rate of the concentrated slurry in the concentration room 5 is not constant, it is difficult to set an automatic discharging at time intervals. In this case, it is desirable a control of opening and closing by means of a self trigger to practice a control in such a way that the opening and closing of the junction portion 6 is made when the amount of accumulation of the concentrated slurry in the concentration room reaches a specified value. In addition, as regards the automatic discharging control means of a centrifugal precipitating apparatus to be used in this invention, it is needless to say that some control method other than the above-mentioned may be appropriate.

As described in the above, it is possible to discharge concentrated slurry having impurities removed at a high rate out of the concentration room 5 by the opening of the junction portion 6, which is an automatic concentrated slurry discharging means of a centrifugal precipitating apparatus of a disk type to be desirably used in this invention and located at the border between the upper member 2 and the lower member 4. Further, because the opening of the junction portion 6 is only several millimeters and it is closed in a short time, the shock accompanied by the opening and closing is made not to be generated to the utmost. Further, also the amount of the high-pressure water used in the opening and closing is suppressed to the utmost, it is an apparatus designed with the response to the requirement of resource saving and energy saving taken into consideration.

As regards the frequency of the opening and closing of the junction portion 6 of a centrifugal precipitating apparatus of a disk type to be desirably used in this invention, because the shock at the time of discharging is of such an order as not to give a load to the apparatus as described in the above, it is not particularly limited to a specified value, and it is of no problem at all from the viewpoint of operation efficiency and production efficiency to carry out the automatic discharging up to about 60 times per hour. Hence, the concentrated slurry collection capability per an hour of a centrifugal precipitating apparatus to be desirably used in this invention is expressed by the following equation, in the case where the slurry having an amount of 70% to the specified capacity is accumulated in the above-mentioned accumulation space and collected, $$\text{concentrated slurry collection capability per one hour} = \text{accumulation space} \times 0.7 \times 60.$$

Further, in a centrifugal precipitating apparatus of a disk type to be desirably used in this invention, because it is possible to carry out slurry concentration in a continuous operation, the amount of the concentrated slurry automatically discharged from the junction portion 6 every time is constant, and concentrated slurry having a quality of constant particle concentration in the concentrated slurry can be obtained.

Further, a centrifugal precipitating apparatus of a disk type to be used in this invention carries out slurry concentration in a moment by the action of a centrifugal force of 5000 G to 15000 G and automatically discharges the concentrated slurry; however, because the opening and closing of the junction portion 6 is frequently made, it does not leave the concentrated slurry remaining in the concentration room 5 for a long time. Hence, because the toner particles in the concentrated slurry are not subject to the influence of the centrifugal force, toner particles which have no disturbance of the orientation of polar radicals and a uniform charging ability on the particle surface and are mechanically sturdy can be obtained.

Further, because the concentrated slurry is automatically discharged with certainty out of the concentration room 5, and no concentrated slurry remains left in the concentration room 5 finally, it is possible to carry out the cleaning of the inside of the concentration room 5 and the dismantling operation of the concentration room at the time of periodical inspection in a simple manner, and the maintenability of the apparatus is also improved by leaps and bounds.

Next, the separation precipitation area of the precipitating plates, which are precipitation means of a centrifugal precipitating apparatus of a disk type to be used in this invention, will be explained.

Figure 4:
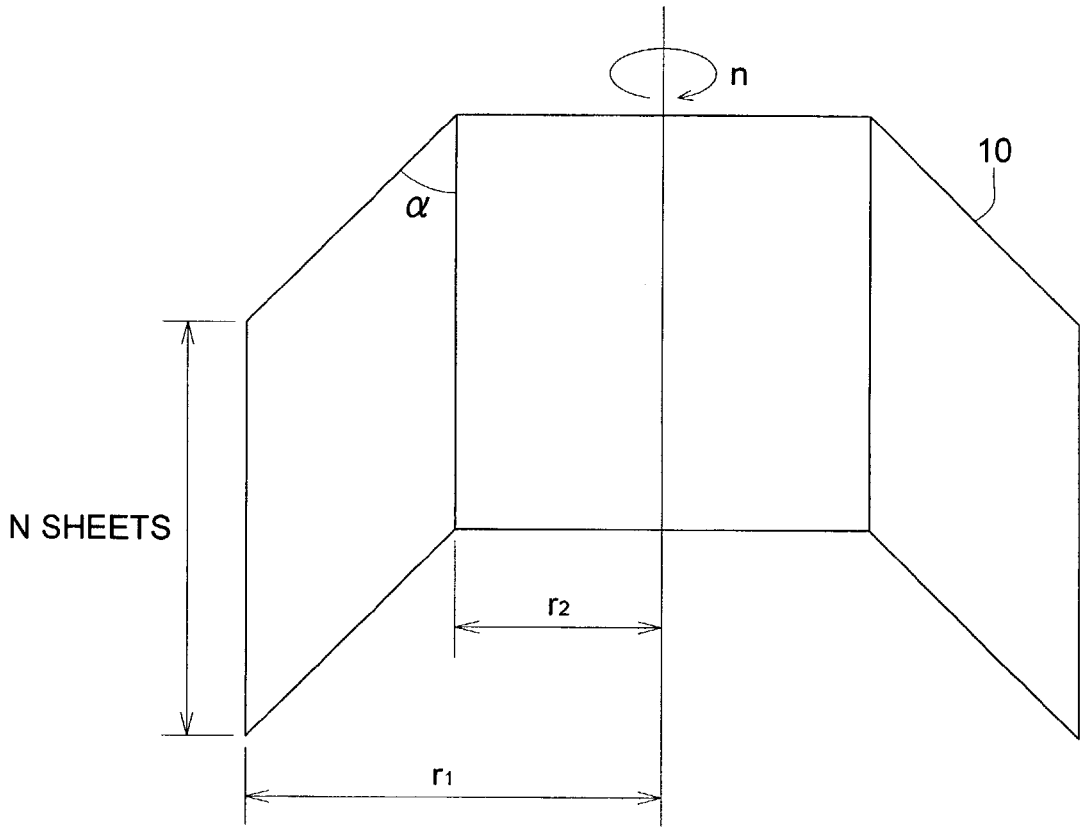
FIG. 4 is a schematic drawing showing the whereabouts of every component in the equation of the separation precipitation area.

It is known by those who are specialized in centrifugal precipitating apparatus that the performance of a centrifugal precipitating apparatus of a disk type to be used in this invention is represented by the separation precipitation area Σ shown by the following equation. Here, a word separation is noted; that is, the word separation is used because the solid component composed of formed particles are separated from the dispersion medium as the liquid component by the centrifugal force at the time of slurry concentration.

$$\text{Separation precipitation area } \Sigma = 2.34 \times 10^{-3} \times n^2 \times N \times \cot\alpha \times (r^{13} - r_2^3),$$

where N denotes the number of the precipitating plates, n denotes the number of revolutions (rpm), $r_1$ denotes the outer (larger) radius of the precipitating plate having a shape of a circular frustum, $r_2$ denotes the inner (smaller) radius of the precipitating plate, and α denotes the half vertex of the precipitating plate (circular cone). FIG. 4 is a schematic drawing showing whereabouts of the constituents in the equation of the separation precipitation area. The half vertex of the precipitating plate represents the degree of inclination of the precipitating plate, and as clearly understood from FIG. 4, it represents the inclination angle of the precipitating plate against the vertical direction. As clearly understood from the above-mentioned equation, in a centrifugal precipitating apparatus to be used in this invention, not only the centrifugal force but also the performance of the precipitating plates are important factors for the purpose of accomplishing the effective removal of impurities from the surface of particles formed.

Further, the recent progress in the centrifugal precipitation technology is surprising, it is found that the value of the separation precipitation area Σ expressed by the above-mentioned equation is deviated from the actual centrifugal precipitation performance, and it is said among those who are specialized in the technology relating to centrifugal precipitating apparatus that the value of the centrifugal precipitation capability index KQ expressed by the following equation reflects the performance of an actual centrifugal precipitating apparatus most satisfactorily.

$$\text{Centrifugal separator capability index } KQ=280\times(n/1000)^{1.5}\times N\times\cot\alpha\times(r_1^{2.75}-r_2^{2.75}).$$

The number of revolutions n of a centrifugal precipitating apparatus of a disk type to be used in this invention is desirably 100 rpm to 10,000 rpm, more desirably 500 rpm to 5000 rpm, and particularly desirably 2000 rpm to 4500 rpm. Further, the number of the precipitating plates N to be arranged in the apparatus, the outer radius of the precipitating plate $r_1$, and the inner radius of the precipitating plate $r_2$ are to be determined in such a way that the maximum separation precipitation area can be obtained in accordance with the setup environment of the apparatus, and by the suitable determination of these values, it is possible to obtain a separation precipitation area not smaller than 10 times of the setup area of the concentration means as described in the foregoing; therefore, even a small-sized concentration means having a small setup area enables the performing of concentration of a large amount of slurry within a short time.

In this way, a centrifugal precipitating apparatus of a disk type has made it possible to obtain a very large precipitation area which could not be achieved absolutely by a conventional centrifugal precipitating apparatus, by the arrangement of cone-shaped thin plates laid one over another to have an extremely short precipitation distance as described in the above. As the result, the apparatus has made it possible to remove the impurities from the surface of particles in a large amount of slurry within an extremely short time, and it has enabled the concurrent slurry concentration.

Further, this invention has made the use of a filter material in slurry concentration unnecessary, has decreased the amount of cleaning water used, and has reduced the load to the drive system for effecting a centrifugal force, while it has reduced electrical power consumption; that is, toner production to cope with resource saving has become possible.

Next, with reference to FIG. 1, the above-described explanation concerning a centrifugal precipitating apparatus of a disk type to be desirably used in this invention will be complemented.

The rotor 3 making up the main body of a centrifugal precipitating apparatus of a disk type to be desirably used in this invention forms a united structure by the coupling with the upper member 2 with a gripping ring 30. Further, it is confirmed that the lower member 4 is formed as one united body with the rotor 3.

The upper member 2 and the lower member 4 making up the main body 1 has a shape of two bowls laid one upon another to form the junction portion 6 which is able to be opened and closed; it is desirable that the outer diameter of the lower member 4 at the junction portion is a little larger than the outer diameter of the upper member 2 for the purpose of securing with certainty the tight shutting of the inside of the concentration room 5 as a containing part.

As described in the above, 7 denotes the lower member operation room, and high-pressure water fills it and is discharged from it in order to carry out a vertical movement of the lower member 4 to make the opening and closing of the junction portion 6. The lower member operation room 7 is provided with an inlet of high-pressure water 8 and an outlet of it 9.

In the concentration room 5, precipitating plates (also called a disk stack) consisting of a plurality of cone-shaped separation disks are arranged around the axis of rotation of the rotor 3. 11 denotes a distributor. As shown in FIG. 1, at the upper end of the upper member, a liquid accumulation room 12 is disposed, and it is possible to feed dispersion liquid containing the impurity particles separated from the slurry from the concentration room 5 through a path 13 to this liquid accumulation room 12.

During the operation of the rotor 3, the liquid accumulated in the liquid accumulation room 12 forms a rotating liquid body having a free liquid surface 14 lying on the inner side in the radial direction.

A tube which penetrates through the liquid accumulation room 12, extends to the center, and is fixed is a feed tube 15, which is a tube for introducing slurry to be subjected to concentration and removal of impurities from the surface of particles (hereinafter referred to as diluted slurry) into the concentration room 5. The feed tube 15 has its opening end in a feed room 16 which is the inner room of the distributor 11. A fixed feed-out tube 17 located at the upper part of the feed tube 15 is arranged for the purpose of separating liquid having a light specific weight in the dispersion liquid accumulated in the liquid accumulation room 12. Further, a feed-out device 18 is arranged around the feed tube 15 in the accumulation room 12, and is connected to the feed-out tube 17. The feed-out device 18 is fixed, but it is also possible in another feed-out structure to arrange a similar feed-out device in a manner to rotate at a speed lower than the rotational speed of the rotor.

The feed-out device 18 extends in the radial direction in the liquid accumulation room 12, and has a portion positioned outside the radial direction level of the free liquid surface 14. In the feed-out device 18, there is arranged at least one feed-out path 20 as well as a feed inlet, and this feed inlet is positioned at this portion, and forms an exit from the liquid accumulation room 12. The feed-out path 20 is connected to the inside of the feed-out tube 17.

As shown in FIG. 2, the path 13 is arranged at the central part inside the concentration room 5. In the liquid accumulation room 12, several wall elements are arranged around the rotary shaft, and forms flow paths between the neighboring elements, in order to carry the separated liquid existing in the liquid accumulation room 12 and lead it towards the outside in the radial direction to the exit during the operation by the rotation of the rotor 3. In this case, at least a part of the wall elements extends in the radial direction between a level in the radial direction where the free liquid surface is located and a level at the outside of the exit in the radial direction.

Subsequently, with reference to FIG. 1, the concentration process in a centrifugal precipitating apparatus to be used in this invention will be explained.

At the start of the centrifugal precipitating apparatus, the rotor 3 rotates, and by the supply of high-pressure water from the inlet 8 to the lower member operation room 7, the junction portion 6 between the upper member 2 and the lower member 4 is strongly pressed to be brought into a tight contact to close the concentration room 5. When the concentration room 5 is blockaded, dilute slurry is supplied from the feed tube 15 through the feed room 16. About the time when the concentration room 5 is filled with the dilute slurry, the rotor 3 comes to have the number of revolutions in the normal operation, and the condition in the concentration room is stabilized. While the influence of the centrifugal force is exerted to the supplied slurry, the removal of impurities from the surface of the particles in the dilute slurry is carried out, and at the same time, concentration of the slurry is also carried out.

At this time, the removal of impurities and concentration are carried out mainly in the spaces formed between the neighboring cone-shaped precipitating plates 10. During operation, toner particles, which are a component having a larger specific weight in the dilute slurry, are thrown out to the outside in the radial direction, and accumulated in the outermost part in the radial direction of the concentration room 5. On the other hand, the dispersion liquid component containing impurity particles having a lighter specific weight in the dilute slurry flows to the innermost side in the radial direction of the concentration room 5.

After the passage of a definite time, when the junction portion 6 at the periphery is opened by several millimeters by the downward movement of the lower member 4, the particle component ejected forcibly to the outside of the concentration room 5 by the centrifugal force caused by the rotor, and the liquid component containing impurities flows out of the concentration room 5 and enters the liquid accumulation room 12 through the path 13, where it forms a rotating liquid body having a free liquid surface facing toward the inner side in the radial direction. The liquid in the liquid accumulation room 12 passes the exit, passes through the fixed feed-out path 20 in the feed-out device 18, and is ejected to the outside of the apparatus.

The transport of the liquid component contained in the liquid accumulation room 12 is done by the wall elements rotating with the rotor 3 and the fixed surface of the liquid accumulation room 12.

The portion of the liquid located at the nearest position to the feed-out device 18 has its speed decelerated by the contact with the exit surface of the feed-out device. In this way, various parts of the liquid in the liquid accumulation room 12 come to have various rotational speed respectively. By the contact of the liquid with the outer surface of the feed-out device 18, a circulating liquid flow is generated in the liquid accumulation room 12, and as described in the above, the liquid flows along the outer surface of the feed-out device 18 to the inside in the radial direction, and flows to the outside in the radial direction along the rear one, as seen from the rotating direction, of the two wall elements forming the flow path.

In this way, it becomes possible by the use of a centrifugal precipitating apparatus of a disk type to be desirably used in this invention, to carry out, in a continuous operation, the concentration of slurry containing particles formed in an aqueous medium without the use of a filter material, the removal of impurities from the surface of the particles, and further, an automatic discharging of the concentrated slurry to the outside of the apparatus.

Further, in this invention, it is also appropriate to repeat the operation of carrying out the slurry concentration again after the concentrated slurry obtained is again dispersed in a washing liquid to wash the particles sufficiently. In addition, in this invention, a toner having a better charging ability can be obtained in the case where the total amount of washing water for carrying out the dispersion of the concentrated slurry again falls within a range of 5 to 10 times of the amount of the slurry subjected to the first concentration processing. That is, it was confirmed that by the use of a toner obtained by the use of washing water of the amount falling within the above-mentioned range, the charging ability was not changed even after the practice of continuous copying exceeding three million sheets. Further, a better effect could not be found in the case of the total amount of washing water exceeding 10 times.

Next, toner particles to be obtained by a production method according to this invention will be explained. By a production method of this invention, as shown in FIG. 5 for example, it is possible to obtain a toner particle having a sea-island structure in which the components, namely, a resin component making up the particles, crystalline substance particles which are the releasing agent component, and coloring agent particles, are not mixedly dissolved in one another and form the respective phases independently. The toner particle shown in FIG. 5 has a structure such that islands A of a crystalline substance making up the releasing agent and islands B of the coloring agent component exist in a continuous phase (sea) of the resin. In addition, as regards means for confirming the structure of the toner particles obtained by this invention, in a cross-sectional photograph taken by means of a transmission type electron microscope, the regions of sea and the regions of islands are shown as regions having different brightness.

Next, things concerning the particle diameter of a toner of this invention will be explained. The particle diameter of a toner to be used in this invention is 3 μm to 9 μm as expressed by number-average particle diameter, desirably 3.5 μm to 8.0 μm, and more desirably 3.5 μm to 7.5 μm. This particle diameter can be controlled by the concentration of the coagulating agent (salting-out agent), the amount of the organic solvent added, fusing time, and the composition of the polymer in the production process of the toner particles.

By making the number-average particle diameter 3 μm to 9 μm, one can enhance the transfer efficiency to improve the image quality in half-tone areas and the image quality of fine lines and dots. The calculation of the particle diameter distribution and the measurement of the number-average particle diameter of a toner can be carried out by the use of a COULTER COUNTER TA-II, a COULTER MULTISIZER (both manufactured by COULTER Co., Ltd.), a SLAD1100 (a laser diffraction type particle diameter measuring apparatus manufactured by SHIMADZU Corp.). In this invention, by the use of a COULTER MULTISIZER, the measurement and calculation were done with an interface for outputting the particle diameter distribution data (manufactured by NIKKAKI Corp.) and a personal computer connected.

Next, a production method of a toner according to this invention will be explained.

A toner according to this invention is produced by a means for carrying out the agglomeration of resin particles in an aqueous medium to make particle formation, that is, an apparatus for at least carrying out polymerization of a polymerizable monomer and coagulating the polymerization product obtained; this production method is such one that a polymerizable monomer is polymerized by a suspension polymerization method to prepare resin particles, or an emulsion polymerization or an mini-emulsion polymerization of a monomer is carried out in a liquid (an aqueous medium) with a emulsion liquid of necessary additional agents added to prepare fine resin particles, and after the addition of resin particles having a charge controlling ability as occasion demands, an organic solvent and a coagulating agent such as a salt, etc. are added to agglomerate and fuse to bond said resin particles to one another.

<Suspension Polymerization Method>

In an example of a toner production method of this invention, resin having a charge controlling ability is dissolved in a polymerizable monomer, various kinds of constituent material such as a coloring agent, a releasing agent as occasion demands, and further a polymerization initiator are added, and the various kinds of constituent material are dissolved or dispersed in the polymerizable monomer by means of a homogenizer, a sand mill, a sand grinder, or an ultrasonic dispersion device. The polymerizable monomer having these various kinds of constituent material dissolved or dispersed is dispersed in an aqueous medium containing a dispersion stabilizer by the use of a homomixer or a homogenizer to become oil drops having a desired size as a toner. After that, it is moved to a reaction apparatus (a stirring apparatus) provided with stirring planes as a stirring mechanism to be described later, is filtrated, washed, and further dried to become a toner of this invention prepared. In addition, the word "an aqueous medium" used in this invention represents a medium containing water of at least 50% by weight.

<Emulsion Polymerization Method>

Further, as a toner production method of this invention, a method in which resin particles are salted out and fused to be bonded to one another to prepare toner particles can be cited. For this method, although it is not limited to a particular one, for example, methods disclosed in the publications of the unexamined patent applications H5-265252, H6-329947, and H9-15904 can be cited. That is, a toner of this invention can be formed by a method in which resin particles and dispersion particles of a constituent material such as a coloring agent or fine particles composed of resin, coloring agent, etc. are salted out and agglomerated to be fused and to form fusion-bonded particles from a plurality of the fine particles, and in particular, by a method in which after these components are dispersed in water by the use of a emulsifying agent, they are salted out by the addition of a coagulating agent to a concentration higher than a critical agglomeration concentration, at the same time, the polymer particles formed are heated and fused at a temperature higher than the glass transition temperature of the polymer itself to form fusion-bonded particles with their particle size gradually growing, when the particle diameter reaches the target value, the growth of the particle diameter is stopped by the addition of a large amount of water, the surface of the particles are smoothed while being stirred to have the shape controlled, and the particles are heated to be dried in a fluid state as they remain containing water. In addition, in this process, at the same time as the coagulating agent, it is appropriate to add a solvent soluble infinitely in water such as alcohol.

In a toner production method of this invention, toner particles are obtained by the particle formation from at least complex resin fine particles formed through a process for polymerizing a polymerizable monomer after crystalline substance particles are dissolved in the polymerizable monomer and coloring agent particles. A toner of this invention is obtained through a process of dissolving a crystalline substance in a polymerizable monomer, but this process may be either of dissolving and melting.

Further, a toner production method of this invention is such that particle formation is made with complex resin fine particles obtained by a multi-stage polymerization method and coloring agent particles; therefore, a multi-stage polymerization method will be explained in the following.

<Production Method of Complex Resin Particles Obtained by Multi-Stage Polymerization Method>

A toner production method of this invention is composed of processes shown below.

1: a multi-stage polymerization process,

2: a salting-out/fusion-bonding process for obtaining toner particles by the salting-out/fusion-bonding of complex resin particles and coloring agent particles, 3: a filtration and washing process for filtering toner dispersion liquid to separate toner particles from the liquid and removing a surface active agent etc. from said toner particles, 4: a drying process for drying toner particles having been subjected to the washing process, and 5: a process for adding external additive particles to the toner particles having been subjected to the drying process.

In the following, each process will be explained in detail.

[Multi-Stage Polymerization Process]

A multi-stage polymerization process is a polymerization process to be practiced for broadening the molecular weight distribution of the resin particles in order to obtain a toner capable of preventing the generation of offset. That is, polymerization reaction is carried out in a manner divided into multiple stages in order to form phases having different molecular weight distributions in each resin particle, and it is done with the intention to make the obtained particles have a molecular weight gradient from the center towards the surface formed. For example, it is employed a method such that, after a dispersion liquid of a high-molecular-weight resin particles is obtained at first, by the further addition of a polymerizable monomer and a chain-transfer agent, a surface layer having a low molecular weight is formed.

In this invention, from the viewpoint of the stability of production and the breakage strength of a toner obtained, it is desirable to employ a multi-stage polymerization method of 3 stages or more. In the following, a two-stage polymerization method and a three-stage polymerization method which are typical examples of the multi-stage polymerization method will be explained. As regards a toner obtained by such a multi-stage polymerization reaction, it is desirable from the viewpoint of breakage strength, a toner having a molecular weight distribution becoming lower towards the surface.

<Two-Stage Polymerization Method>

A two-stage polymerization method is a method of producing complex resin particles composed of a central part (core) formed of high-molecular-weight resin containing a crystalline substance and an outer layer (shell) formed of low-molecular-weight resin.

To explain this method concretely, first, a crystalline substance is dissolved in a monomer to prepare a monomer solution, after this monomer is dispersed in an aqueous medium (for example, an aqueous solution of a surfactant) to become oil drops, and by the polymerization processing of this system (the first-stage polymerization), a dispersion liquid of resin particles having a high molecular weight containing a crystalline substance is prepared.

Subsequently, a polymerization initiator and a monomer for obtaining low-molecular-weight resin are added to this dispersion liquid of resin particles, and by the practice of a polymerization process (the second-stage polymerization) of the monomer under the presence of resin particles, a cover layer composed of the low-molecular-weight resin (a polymerization product of the monomer) is formed on the surface of the resin particles.

<Three-Stage Polymerization Method>

A three-stage polymerization method is a method of producing complex resin particles composed of a central part (core) formed of high-molecular-weight resin, an intermediate layer containing a crystalline substance, and an outer layer (shell) formed of low-molecular-weight resin. In a toner of this invention, the toner particles exist as complex resin particles as described in the above.

To explain this method concretely, first, a dispersion liquid of resin particles obtained by a polymerization process in accordance with a conventional method (the first-stage polymerization) is added in an aqueous medium (for example, an aqueous solution of a surfactant), further, a monomer solution having a crystalline substance dissolved in the monomer is dispersed in the above-mentioned aqueous medium to become oil drops, after that, by the polymerization processing of this system (the second-stage polymerization), a cover layer (an intermediate layer) composed of resin containing a crystalline substance (a polymerization product of the monomer) is formed on the surface of the resin particles (the core particles), and a dispersion liquid of complex resin particles (high-molecular-weight resin–middle-molecular-weight resin) is prepared.

Subsequently, a polymerization initiator and a monomer for obtaining low-molecular-weight resin are added to the dispersion liquid of the complex resin particles obtained, and by the polymerization processing of the monomer (the third-stage polymerization) under the presence of the complex resin particles, a cover layer composed of low-molecular-weight resin is formed on the surface of the complex resin particles. In the above-mentioned method, by the incorporating of an intermediate layer, it becomes possible to disperse crystalline substance particles finely and uniformly; this is desirable.

In a toner production method of this invention, to polymerize a polymerizable monomer in an aqueous medium is one characteristic. That is, when resin particles (core particles) containing a crystalline substance or cover layers (intermediate layers) are formed, a crystalline substance is dissolved in monomer, and the monomer solution obtained is dispersed in an aqueous medium to become oil drops, and by a polymerization process carried out by the addition of a polymerization initiator, toner particles are obtained as latex particles.

The term "an aqueous medium" used in this invention means a medium composed of water of 50% to 100% by weight and a water-soluble organic solvent of 0% to 50% by weight. For the water-soluble organic solvent, for example, methanol, ethanol, isopropanol, butanol, acetone, methylethylketone, tetrahydrofuran, etc. can be cited; it is desirable an organic solvent belonging to alcohol group which does not dissolve the resins to be obtained.

For the polymerization method suitable to form a resin particle containing a crystalline substance or a cover layer, it can be cited a method in which a monomer solution having a crystalline substance dissolved in the monomer is dispersed in an aqueous medium having a surfactant dissolved to a concentration lower than the critical micelle concentration by the utilization of mechanical energy, which gives a dispersion liquid having oil drops dispersed, and by the addition of a water-soluble polymerization initiator to the dispersion liquid obtained, a radical polymerization is performed in the oil drops (hereinafter referred to as "a mini-emulsion method"); this method is desirable because it can exhibit the effect of this invention more satisfactorily. In addition, in the above-mentioned method, instead of a water-soluble polymerization initiator, or together with a water-soluble polymerization initiator, an oil-soluble polymerization initiator may be used.

By a mini-emulsion method in which oil drops are mechanically formed, crystalline substance dissolved in the oil phase is taken away by only a small amount, which is different from a conventional emulsion polymerization method, and a sufficient amount of the crystalline substance can be introduced in the resin particles or cover layers to be formed.

For the dispersion apparatus for practicing oil drop dispersion by mechanical energy, it is not limited to a particular one, and for example, a stirring apparatus equipped with a rotor rotatable at a high speed "CLEARMIX" (manufactured by M. TECHNIQUE Co., Ltd.), an ultrasonic dispersion apparatus, a mechanical homogenizer, a Manton Gorin, and a pressure-type homogenizer can be cited. Further, as regards the dispersion particle diameter, it should be 10 nm to 1000 nm, desirably 50 nm to 1000 nm, and more desirably 30 nm to 300 nm. In this case, by making the dispersion particle diameter have a distribution, one may control the phase separation structure of the crystalline substance in the toner particles, namely, the Felle diameter, the shape factor, and the variation factors of these. Further, as regards the dispersion particle diameter, it should be 10 nm to 1000 nm, desirably 50 nm to 1000 nm, and more desirably 30 nm to 300 nm. In this case, by making the dispersion particle diameter have a distribution, one may control the phase separation structure of the crystalline substance in the toner particles, namely, the Felle diameter, the shape factor, and the variation factors of these.

Besides, for another polymerization method for forming resin particles containing a crystalline substance or cover layers, a method known to the public such as an emulsion polymerization method, a suspension polymerization method, or a seed polymerization method can be also employed. Further, these polymerization methods can be employed also for the purpose of obtaining resin particles (core particles) or cover layers not containing a crystalline substance.

It is desirable that the particle diameter of the complex resin particles to be obtained by this polymerization process falls within a range of 10 nm to 1000 nm as expressed by a weight-average particle diameter to be measured by means of an electrophoresis light scattering photometer "ELS-800" (manufactured by OHTSUKA Electronics Corp.)

Further, it is desirable that the glass transition temperature (Tg) of the complex resin particles falls within a range of 48° C. to 74° C., and desirably 52° C. to 64° C.

Further, it is desirable that the softening point of the complex resin particles falls within a range of 95° C. to 140° C.

A toner produced by this invention is one to be obtained by the formation of a resin layer formed of fused resin particles on the surface of resin and coloring agent particles by a salting-out/fusion-bonding method or the like; this will be explained in the following.

[Particle Formation Process]

This particle formation process is a process in which complex resin particles obtained by the above-mentioned multi-stage polymerization process are agglomerated with and fused to coloring agent particles or complex resin particles, and toner particles having an indefinite shape (an aspherical shape) are obtained by the fusion-bonding of these particles together. For the method of coagulating and fusing particles to one another in this process, in addition to the salting-out/fusion-bonding method to be described below, a method in which agglomeration particles are fused to one another by heat after the completion of agglomeration done by salting-out at a temperature not higher than the glass transition temperature, a method in which agglomeration is made by the use of heat or an organic solvent, etc. can be cited. In the following, a salting-out/fusion-bonding method will be explained.

The above-mentioned "salting-out/fusion-bonding" means the concurrence of salting out (agglomeration of particles) and fusion bonding (disappearance of the border surface between particles) or an operation to make it happen. In order to make salting out and fusion bonding occur at the same time, it is necessary to agglomerate particles (complex resin particles, coloring agent particles) under a temperature condition higher than the glass transition temperature (Tg) of the resin making up the complex resin particles.

It is also appropriate that, in a particle formation process based on this salting-out/fusion-bonding, internal additive particles such as charge controlling agent particles (fine particles having a number-average primary particle diameter of an order of 10 nm to 1000 nm) are subjected to salting-out/fusion-bonding together with the complex resin particles and coloring agent particles.

[Ripening Process]

A ripening process is a process succeeding the particle formation process, and it is a process in which the crystalline substance particles are subjected to phase separation by it that the temperature is kept at temperatures near the melting point of the crystalline substance, desirably within a range of the melting point ±20° C. also after the fusion bonding of the resin particles, and stirring is continued with a constant degree of strength. It is possible to control in this process the Felle diameter, the shape factor, and the variation factors of these of the crystalline substance.

[Concentration and Washing Process]

In this concentration and washing process, impurity particles such as free releasing agent particles and coloring agent particles are removed from the surface of the toner particles obtained by the particle formation process, and also the concentration of the slurry is carried out by the removal of the aqueous medium in the dispersion system (slurry) containing the toner particles. Further, it is also a process to carry out the removal of attached substances such as a surfactant and a salting-out agent from the toner particles by the re-dispersion of the concentrated slurry in a washing liquid. As described in the above, this invention has accomplished in this process the removal of impurities from the surface of particles, without the change in the charging ability of the produced particles and the fracture or breakage of the particles, through the practice of slurry concentration using the above-mentioned centrifugal precipitating apparatus. Besides, in this invention, it is also appropriate to practice a process to remove impurities on the surface of particles with more certainty, by the repetition of the operation of condensing the slurry again after the slurry once concentrated is put into washing water, diluted, and washed.

In this way, after the concentration and washing of the slurry is repeated, a wet cake (an aggregate of particles like a cake) having a particle ratio of about 50% is obtained.

[Drying Process]

This process is a process to practice a drying processing of the toner particles separated from the concentrated slurry.

For the drier to be used in this process, a spray drier, a vacuum freezing drier, a decompression drier, etc. can be cited; it is desirable to use a standing rack drier, a moving rack drier, a fluidized bed drier, a rotary drier, a stirring drier, etc.

It is desirable that the water content of the toner particles having been subjected to the drying processing is not greater than 5% by weight, and desirably not greater than 2% by weight.

In addition, it is also possible, in the case where the toner particles having been subjected to the drying processing are agglomerated to one another by a weak inter-particle attraction force, to apply a crushing processing to said aggregate. In this case, for the crushing apparatus, a mechanical crushing apparatus such as a jet mill, a Henschel mixer, a coffee mill, a food processor can be used.

It is desirable that a toner of this invention is prepared by a process in which complex resin particles are formed under the absence of a coloring agent, a dispersion liquid of coloring agent particles is added to a dispersion liquid of said complex resin particles, and said complex resin particles and coloring agent particles are agglomerated and fused to perform the particle formation.

Next, the constituents to be used in the toner production process will be explained in detail.

(Polymerizable Monomer)

For the polymerizable monomers to produce a resin material (a binder) to be used in this invention, a hydrophobic monomer is an essential constituent, and a bridging monomer is used as occasion demands. Further, it is desirable that at least one kind of a monomer having an acid polar radical or basic polar radical in the structure as described below is contained.

(1) Hydrophobic Monomer

For the hydrophobic monomer composing a monomer constituent, it is not limited to a particular one, and a monomer heretofore known to the public can be used. Further, so as to satisfy the required characteristics, a monomer of one kind or a combination of monomers of two or more kinds can be used.

To state it concretely, monovinyl aromatic monomer, a (meth)acrylic ester monomer, a vinyl ester monomer, a vinylether monomer, monoolefine monomer, diolefine monomer, halogenated olefine monomer, etc. can be used.

For the vinyl aromatic monomer, for example, a styrene monomer such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, etc. and derivatives of these can be cited.

For a (meth)acrylic ester monomer, acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate, etc. can be cited.

For the vinyl ester monomer, vinyl acetate, vinyl propionate, vinyl benzoate, etc. can be cited; for the vinylether monomer, vinylmethyl ether, vinylethyl ether, vinylisobutyl ether, vinylphenyl ether, etc. can be cited.

Further, for a monoolefine monomer, ethylene, propylene, isobutylene, 1-butene, 1-pentene, 4-methyl-1-pentene, etc. can be cited; for the diolefine monomer, butadiene, isoprene, chloroprene, etc. can be cited.

(2) Bridging Monomer

It is also appropriate to add a bridging monomer for the purpose of improving the characteristics of resin particles. For the bridging monomer, for example, one having two or more unsaturated bonds such as divinyl benzene, divinyl naphthalene, divinyl ether, diethyleneglycol methacrylate, ethyleneglycol dimethacrylate, polyethyleneglycol dimethacrylate, diaryl phthalate, etc. can be cited.

(3) Monomer Having an Acid Polar Radical

For the monomer having an acid polar radical, (a) α, β-ethylene unsaturated compounds having a carboxyl radical (—COOH), and (b) α, β-ethylene unsaturated compounds having a sulfone radical (—$SO_3H$) can be cited.

For the examples of (a) α, β-ethylene unsaturated compounds having a carboxil radical (—COOH), acrylic acid, methacrylic acid, fumaric acid, maleic acid, itaconic acid, cinnamic acid, monobutyl maleic ester, monooctyl maleic ester, and metal salts such as Na salts and Zn salts of these can be cited.

For the examples of (b) α, β-ethylene unsaturated compounds having a sulfone radical (—$SO_3H$), sulfonated styrene and its Na salt, arylsulfosuccinic acid, octyl arylsulfosuccinate, and Na salts of these can be cited.

(4) Monomer Having a Basic Polar Radical

For the monomer having a basic polar radical, (a) (meth) acrylic esters of aliphatic alcohol of 1 to 12, desirably 2 to 8, particularly desirably 2 carbon atoms having an amine radical or a quaternary ammonium radical, (b) (meth)acrylic acid amides or (meth)acrylic acid amides arbitrarily mono-substituted or di-substituted by an alkyl radical of 1 to 18 carbon atoms at the N site, (c) vinyl compounds substituted by a heterocyclic radical having N as a ring member, and (d) N,N-diaryl-alkyl amines or its quaternary ammonium salts can be shown as examples. Among them, (a) a (meth)acrylic acid ester of aliphatic alcohol having an amine radical or a quaternary ammonium radical is desirable as a monomer having a basic polar radical.

For the examples of (a) (meth)acrylic acid esters of aliphatic alcohol having an amine radical or a quaternary ammonium radical, dimethylaminoethyl acrylate, dimethylaminoethyl methacrylate, diethylaminoethyl acrylate, diethylaminoethyl methacrylate, a quaternary ammonium salt of the above-mentioned 4 compounds, 3-dimethylaminophenyl acrylate, 2-hydroxy-3-methacryloxypropyltrimethyl ammonium salt, etc. can be cited.

For (b) the (meth)acrylic acid amide or the (meth)acrylic acid amide arbitrarily mono-substituted or di-substituted by an alkyl radical at the N site, acryl amide, N-butylacryl amide, N,N-dibutylacryl amide, piperidylacryl amide, methacryl amide, N-butylmethacryl amide, N,N-dimethylacryl amide, N-octadecylacryl amide, etc. can be cited.

For (c) the vinyl compound substituted by a heterocyclic radical having N as a ring member, vinylpyridine, vinylpyrrolidone, vinyl-N-methylpyridinium chloride, vinyl-N-ethylpyridinium chloride, etc. can be cited.

For (d) the N,N-diaryl-alkylamine or its quaternary ammonium salt, N,N-diarylmethylammonium chloride, N,N-diarylethylammonium chloride, etc. can be cited.

(Polymerization Initiator)

For a radical polymerization initiator to be used in this invention, any water-soluble one can be suitably used. For example, persulfate salts (for example, potassium persulfate, ammonium persulfate, etc.), azo compounds (for example, 4,4'-azobis-4-cyanovaleric acid and its salts, 2,2'-azobis(2-amidinopropane) salts, etc.), peroxide compounds, etc. can be cited. Further, the above-mentioned radical polymerization initiator can be combined with a reducing agent to become a redox initiator. By the use of a redox initiator, it is exhibited a desirable effect such that polymerization activity is enhanced, lowering of the polymerization temperature can be achieved, and further, the shortening of the polymerization time can be accomplished.

The polymerization temperature is not limited to a particular one so long as it is not lower than the lowest radical generation temperature of the polymerization initiator; for example, it falls within a range of 50° C. to 90° C. However, by the use of a polymerization initiator capable of starting at the normal temperature composed of the combination of hydrogen peroxide and a reducing agent (ascorbic acid etc.), it is possible to make polymerization at the room temperature or a temperature higher than that.

(Chain-Transfer Agent)

For the purpose of adjusting molecular weight, it is possible to use a chain-transfer agent known to the public. For the chain-transfer agent, although it is not limited to a particular one, for example, compounds having a mercapto radical such as octylmercaptan, dodecilmercaptan, and tert-dodecylmercaptan can be used. Particularly, a compound having a mercapto radical suppresses the offensive smell at the time of heat fixing and gives a toner having a sharp molecular weight distribution; it is desirably used for its being excellent in preservation durability, fixing strength, and offset resistance. For desirable examples, for instance, ethyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, an ethyleneglycol compound having a mercapto radical, a neopentylglycol compound having a mercapto radical, a pentaerythritol compound having a mercapto radical, etc. can be cited. Among these, from the viewpoint of suppressing the bad smell at the time of toner heat fixing, n-octyl-3-mercaptopropionic ester is particularly desirable.

(Surfactant)

In order to practice particularly a mini-emulsion polymerization by the use of the above-mentioned polymerizable monomer, it is desirable to carry out an oil drop dispersion in an aqueous medium by the use of a surfactant. For a surfactant which can be used in this case, although it is not limited to particular one, the following ionic surfactants can be cited as examples of suitable compound.

For the ionic surfactant, for example, sulfonic acid salts (sodium dodecylbenzenesulfonate, sodium arylalkylpolyethersulfonate, sodium 3,3-disulfonediphenylurea-4,4-diazobis-amino-8-naphthol-6-sulfonate, orthocarboxybenzene-azo-dimethylaniline, sodium 2,2,5,5-tetramethyl-triphenylmethane-4,4-diazo-bis-β-naphthol-6-sulfonate, etc.), sulfuric acid salt esters (sodium dodecylsulfate, sodium tetradecylsulfate, sodium pentadecylsulfate, sodium octylsulfate, etc.), and fatty acid salts (sodium oleate, sodium laurate, sodium caprate, sodium caprylate, sodium capronate, potassium stearate, calcium oleate, etc.) can be cited.

In this invention, a surfactant expressed by the following general formula (1) or (2) is desirably used:

$$R^1(OR^2)_nOSO_3M, \text{ General formula} \quad (1)$$

$$R^1(OR^2)_nSO_3M. \text{ General formula} \quad (2)$$

In the general formulae (1) and (2), $R^1$ represents an alkyl radical or an arylalkyl radical having 6 to 22 carbon atoms, desirably an alkyl radical or an arylalkyl radical having 8 to 20 carbon atoms, and more desirably an alkyl radical or an arylalkyl radical having 9 to 16 carbon atoms.

For the alkyl radical having 6 to 22 carbon atoms represented by $R^1$, for example, an n-hexyl radical, an n-heptyl radical, an n-octyl radical, an n-decyl radical, an n-undecyl radical, an n-hexadecyl radical, a cyclopropyl radical, a cyclopentyl radical, a cyclohexyl radical, etc. can be cited. For the arylalkyl radical represented by $R^1$, a benzyl radical, a diphenylmethyl radical, a cinnamyl radical, a styryl radical, a trityl radical, a phenethyl radical, etc. can be cited.

In the general formulae (1) and (2), $R^2$ represents an alkylene radical having 2 to 6 carbon atoms, and desirably an alkylene radical having 2 or 3 carbon atoms. For the alkylene radical having 2 to 6 carbon atoms, an ethylene radical, a trimethylene radical, a tetramethylene radical, a propylene radical, an ethylethylene radical, etc. can be cited.

In the general formulae (1) and (2), n represents one of the integers 1 to 11, desirably 2 to 10, more desirably 2 to 5, and particularly desirably 2 and 3.

In the general formulae (1) and (2), for the monovalent metal element represented by M, sodium, potassium, and lithium can be cited. Among these, sodium is desirably used.

In the following, concrete examples of the surfactants represented by the general formula (1) or (2) will be shown, but this invention should not be limited to these.

Compound (101): $C_{10}H_{21}(OCH_2CH_2)_2OSO_3Na$,
Compound (102): $C_{10}H_{21}(OCH_2CH_2)_3OSO_3Na$,
Compound (103): $C_{10}H_{21}(OCH_2CH_2)_2SO_3Na$,
Compound (104): $C_{10}H_{21}(OCH_2CH_2)_3SO_3Na$,
Compound (105): $C_8H_{17}(OCH_2CH(CH_3)_2OSO_3Na$,
Compound (106): $C_{18}H_{37}(OCH_2CH_2)_2OSO_3Na$.

In this invention, from the viewpoint of keeping the charge holding function of a toner in a good condition, suppressing the generation of the background density in a high-temperature high-humidity environment, and improving the transfer efficiency, and further from the viewpoint of suppressing the rise of the charge quantity in a low-temperature low-humidity environment and stabilizing the toner deposition quantity in the development process, the quantity of the surfactant expressed by the above-mentioned general formula (1) or (2) to be contained in a toner for developing an electrostatic image is desirably 1 to 1000 ppm, more desirably 5 to 500 ppm, and particularly desirably 7 to 100 ppm.

In this invention, by making the quantity of the surfactant to be contained in a toner fall within the above-mentioned range, it is possible to give and maintain in a uniform and stable state the charging ability of a toner for developing an electrostatic image of this invention without being subject to the influence of the environment.

Further, the quantity of the surfactant expressed by the above-mentioned general formula (1) or (2) to be contained in a toner for developing an electrostatic image of this invention is calculated by a method shown below.

1 g of toner is dissolved in 50 ml of chloroform, and the surfactant is extracted from the chloroform layer with 100 ml of ion-exchange water. Further, the chloroform layer having been subjected to the extraction is subjected to another extraction again with 100 ml of ion-exchange water, and total 200 ml of extraction liquid (water layer) is obtained; this extraction liquid is diluted up to 500 ml.

By the use of this diluted liquid as a test liquid, according to the method specified in the term JIS 33636, it is made to exhibit a color by methylene blue, its light absorption coefficient is measured, and the quantity of the surfactant contained in the toner is measured from a calibration curve which have been prepared separately.

Further, the chemical structure of the surfactants expressed by the general formula (1) or (2) was determined through the analysis of the above-mentioned extraction liquid by means of a 1H-NMR apparatus.

In this invention, in the process for salting-out, coagulating, and fusion-bonding the resin particles from the dispersion liquid of resin particles prepared in an aqueous medium, a metal salt can be desirably used as a coagulating agent, and a salt of a divalent or trivalent metal can be more desirably used. The reason is that a salt of a divalent or trivalent metal has a critical coagulation concentration (coagulation value or coagulation point) smaller than a monovalent metal salt.

Further, in this invention, a nonion surfactant can be used; to state it concretely, polyethylene oxide, polypropylene oxide, a combination of polypropylene oxide and polyethylene oxide, an ester of polyethyleneglycol and a higher fatty acid, alkylphenolpolyethylene oxide, an ester of a higher fatty acid and polyethyleneglycol, an ester of a higher fatty acid and polypropylene oxide, a sorbitan ester, etc. can be cited.

In this invention, these surfactants are used as an emulsifying agent in emulsion polymerization, but they may be used in another process or for another purpose.

(Molecular Weight Distribution of Resin Particles and Toner)

It is desirable that a toner of this invention has the peaks or shoulders of its molecular weight distribution falling within a range of 100,000 to 1,000,000 and a range of 1,000 to 50,000, and more desirably the peaks or shoulders should fall within a range of 100,000 to 1,000,000, a range of 15,000 to 100,000 and a range of 1,000 to 50,000.

As regards the molecular weight of the resin particles, it is desirable a resin containing two components, one of which is a high-molecular-weight component having its peak or shoulder falling within a range of 100,000 to 1,000,000 and the other of which is a low-molecular-weight component having its peak or shoulder falling within a range of 1,000 to 50,000, and it is more desirable to use a resin having an intermediate molecular weight with its peak or shoulder falling within a range of 15,000 to 100,000.

As regards a method of measurement of the above-mentioned molecular weight of a toner or resin, it is appropriate to use a measurement based on GPC (Gel Permeation Chromatography) using THF (tetrahydrofuran) for the solvent. That is, 1.0 ml of THF is added to 0.5 mg-5.0 mg, to state it more concretely, 1.0 mg of a measurement sample, and by the stirring using a magnetic stirrer or the like the room temperature, the sample is sufficiently dissolved. Subsequently, after a treatment using a membrane filter having a pore size of 0.45 μm to 0.50 μm, it is introduced into GPC. Under a condition such that the column is stabilized at 40° C., THF is made to flow at a rate of 1.0 ml per minute, and about 100 μl of the sample of a concentration of 1 mg/ml is injected, the measurement is carried out. For the column, it is desirable to use a combination of gel columns of polystyrene on the market. For example, a combination of SHODEX GPC KF-801, 802, 803, 804, 805, 806, and 807 manufactured by SHOWA DENKO K. K., and a combination of TSK gel G1000H, G2000H, G3000H, G4000H, G5000F1, G6000H, G7000H, and TSK guard column manufactured by TOSO Co., Ltd. can be cited. Further, for the detector, it is appropriate to use a refractive index detector (an IR detector), or a UV detector. In the molecular weight measurement of the sample, the molecular weight distribution of the sample is calculated by the use of a calibration curve prepared by the use of mono-dispersion polystyrene standard particles. For the polystyrene standard particle specimens to be used in the preparation of the calibration curve, it is appropriate to use about 10 specimens of them. Subsequently, after a treatment using a membrane filter having a pore size of 0.45 μm to 0.50 μm, it is introduced into GPC. Under a condition such that the column is stabilized at 40° C., THF is made to flow at a rate of 1.0 ml per minute, and about 100 μl of the sample of a concentration of 1 mg/ml is injected, the measurement is carried out. For the column, it is desirable to use a combination of gel columns of polystyrene on the market. For example, a combination of Shodex GPC KF-801, 802, 803, 804, 805, 806, and 807 manufactured by SHOWA DENKO K. K., and a combination of TSK gel G1000H, G2000H, G3000H, G4000H, G5000H, G6000H, G7000H, and TSK guard column manufactured by TOSO Co., Ltd. can be cited. Further, for the detector, it is appropriate to use a refractive index detector (an IR detector), or a UV detector. In the molecular weight measurement of the sample, the molecular weight distribution of the sample is calculated by the use of a calibration curve prepared by the use of mono-dispersion polystyrene standard particles. For the polystyrene standard particle specimens to be used in the preparation of the calibration curve, it is appropriate to use about 10 specimens of them.

(Coagulating Agent)

In this invention, in the process for salting out, coagulating, and fusion-bonding the resin particles from the dispersion liquid of resin particles prepared in a aqueous medium, a metal salt is desirably used as a coagulating agent, and to use a salt of a divalent or trivalent metal is more desirable. The reason is that a salt of a divalent or trivalent metal has a critical agglomeration concentration (precipitation value or precipitation point) smaller than a monovalent metal salt.

As regards a coagulating agent to be used in this invention, for example, salts of a monovalent metal such as sodium, potassium, and lithium belonging to alkali metal, salts of a divalent metal such as calcium, magnesium, etc. belonging to alkali earth metal, manganese, and copper, salts of a trivalent metal such as iron and aluminum, etc. can be cited.

Concrete examples of these metal salts are shown below. For the salt of a monovalent metal, calcium chloride, zinc chloride, copper sulfate, magnesium sulfate, manganese sulfate, etc. can be cited, and for the salt of a trivalent metal, aluminum chloride, iron chloride, etc. can be cited. These are suitably selected in accordance with the purpose, but salts of a divalent metal or a trivalent metal having a small critical agglomeration concentration are desirable.

The term "critical agglomeration concentration" used in this invention is an index concerning the stability of a dispersed particles in an aqueous dispersion liquid; it indicates the concentration of a coagulating agent added at the occurrence of agglomeration induced by the addition of the coagulating agent. This critical agglomeration concentration changes to a large extent depending on the latex itself and the dispersion agent. For example, it is described in the paper "Seizo Okamura et al, High molecular Chemistry 17, 601 (1960)" etc., and according to the description, the values can be known. Further, as another method, it is also possible that the desired salt is added with a variety of its concentration in a dispersion liquid of particles of object, the ζ-potential of the dispersion liquid is measured, and the salt concentration at the start of change of the ζ-potential is made to be the critical agglomeration concentration.

In this invention, the dispersion liquid of polymer fine particles is processed by the use of a metal salt to have a concentration not lower than the critical agglomeration concentration. At this time, it is arbitrarily selected either to add the metal salt directly or to add the salt as an aqueous solution in accordance with the purpose, which is a matter of course. In the case where the metal salt is added as an aqueous solution, it is necessary that the metal salt added has a concentration not lower than the critical agglomeration concentration for the polymer particles to the sum of the volume of the dispersion liquid of the polymer particles and the volume of the aqueous solution of the metal salt.

In this invention, the concentration of the metal salt is appropriate so long as it is not lower than the critical agglomeration concentration, but desirably the metal salt is added to have a concentration not lower than 1.2 times of the critical agglomeration concentration or more desirably a concentration not lower than 1.5 times of the critical agglomeration concentration.

(Coloring Agent)

A toner of this invention is obtained by the particle formation from the above-mentioned complex resin particles and coloring agent particles. For the coloring agent to make up a toner of this invention (coloring agent particles to be supplied for the particle formation with the complex resin particles), as described in the foregoing, usually an organic pigment is desirably used; however, inorganic pigments and dyes of various kinds other than organic pigments are also used, and the coloring agent is not necessarily limited to organic pigments only.

For the inorganic pigment, one heretofore known to the public can be used; as regards concrete examples of the organic pigment, it is appropriate to use as a black pigment, for example, carbon black such as furnace black, channel black, acetylene black, thermal black, and lampblack, and particles of magnetic substances such as magnetite and ferrite.

It is possible to select and use one or a plurality of these inorganic pigments in accordance with the requirement. Further, the quantity of the pigment to be added is 2% to 20% by weight to the polymer, and desirably 3% to 15% is selected.

In the case where the toner of this invention is used as a magnetic toner, it is possible to add the above-mentioned magnetite. In this case, from the viewpoint of giving the specified magnetic characteristics, it is desirable to add it with an amount of 20% to 60% by weight in the toner. Besides, these organic pigments may be used as ones in a state of a paste of a water-wet coloring agent.

Also for the organic pigment and dye, one heretofore known to the public can be used, and concrete examples of the organic pigment are shown below.

For the pigment to be used as a magenta or red pigment, for example, C. I. pigment red 2, C. I. pigment red 3, C. I. pigment red 5, C. I. pigment red 6, C. I. pigment red 7, C. I. pigment red 15, C. I. pigment red 16, C. I. pigment red 48:1, C. I. pigment red 53:1, C. I. pigment red 57:1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222, etc. can be cited.

For the pigment to be used as an orange or yellow pigment, for example, C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 93, C. I. pigment yellow 94, C. I. pigment yellow 138, C. I. pigment yellow 180, C. I. pigment yellow 185, C. I. pigment yellow 155 C. I. pigment yellow 156, etc. can be cited.

For the pigment to be used as a green or cyan pigment, for example, C. I. pigment blue 15, C. I. pigment blue 15:2, C. I. pigment blue 15:3, C. I. pigment blue 16, C. I. pigment blue 60, C. I. pigment green 7, etc. can be cited.

Further, for the dye, for example, C. I solvent red 1, C. I solvent red 49, C. I solvent red 52, C. I solvent red 58, C. I solvent red 63, C. I solvent red 111, C. I solvent red 122, C. I solvent yellow 19, C. I solvent yellow 44, C. I solvent yellow 77, C. I solvent yellow 79, C. I solvent yellow 81, C. I solvent yellow 82, C. I solvent yellow 93, C. I solvent yellow 98, C. I solvent yellow 103, C. I solvent yellow 104, C. I solvent yellow 112, C. I solvent yellow 162, C. I. solvent blue 25, C. I. solvent blue 36, C. I. solvent blue 60, C. I. solvent blue 70, C. I. solvent blue 93, C. I. solvent blue 95 etc. can be used, and it is also possible to use a mixture of these.

It is possible to select and use one or a plurality of these organic pigments and dyes in accordance with the requirement. Further, the quantity of the pigment to be added is 2% to 20% by weight to the polymer, and desirably 3% to 15% by weight.

(Crystalline Substance)

It is desirable that a toner to be used in this invention is a toner such that resin particles containing a crystalline substance composing the releasing agent component are fusion-bonded in an aqueous medium, and the crystalline substance particles are agglomerated to a suitable degree by a ripening process to form a sea-island structure. As described in the above, by the particle formation in an aqueous medium from the resin particles containing the crystalline substance and the coloring agent particles, a toner having crystalline substance particles finely dispersed can be obtained. In the above, the ripening process means a process in which the stirring of the resin particles are continued also after the fusion bonding within a temperature range of the melting point of the crystalline substance ±20° C.

In a toner of this invention, as the crystalline substance having a releasing function, low-molecular-weight polypropylene (number-average molecular weight 1500 to 9000), low-molecular-weight polyethylene, etc. are desirable, and ester compounds expressed by the chemical formula shown below are particularly desirable:

$$R_1—(OCO—R_2)_n,$$

where n denotes any one of the integers 1 to 4, desirably 2 to 4, more desirable 3 to 4, and particularly desirably 4. Each of $R_1$ and $R_2$ denotes a hydrocarbon radical that may contain a substituent group. It is desirable that $R_1$ has 1 to 40 carbon atoms, desirably it has 1 to 20 carbon atoms, and more desirably 2 to 5 carbon atoms. It is desirable that $R_2$ has 1 to 40 carbon atoms, desirably it has 16 to 30 carbon atoms, and more desirably 18 to 26 carbon atoms.

Next, examples of representative compounds are shown below.

[Chemical formulae 1]

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

-continued

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

[Chemical formulae 2]

16) $CH_3—(CH_2)_{26}—COO—CH_2—C(CH_3)(CH_2—O—CO—(CH_2)_{26}—CH_3)(CH_2—O—CO—(CH_2)_{26}—CH_3)$

17) $CH_3—(CH_2)_{20}—COO—CH_2—C(CH_2CH_3)(CH_2—O—CO—(CH_2)_{20}—CH_3)(CH_2—O—CO—(CH_2)_{20}—CH_3)$

18) $CH_3—(CH_2)_{26}—COO—CH_2—C(CH_2—O—CO—(CH_2)_{26}—CH_3)(CH_2—O—CO—(CH_2)_{26}—CH_3)(CH_2—O—CO—(CH_2)_{26}—CH_3)$

19) $CH_3—(CH_2)_{20}—COO—CH_2—C(CH_2—O—CO—(CH_2)_{20}—CH_3)(CH_2—O—CO—(CH_2)_{20}—CH_3)(CH_2—O—CO—(CH_2)_{20}—CH_3)$

20) $CH_3—(CH_2)_{18}—COO—CH_2—C(CH_2—O—CO—(CH_2)_{18}—CH_3)(CH_2—O—CO—(CH_2)_{18}—CH_3)(CH_2—O—CO—(CH_2)_{18}—CH_3)$

21) $CH_3—(CH_2)_{16}—COO—CH_2—C(CH_2—O—CO—(CH_2)_{16}—CH_3)(CH_2—O—CO—(CH_2)_{16}—CH_3)(CH_2—O—CO—(CH_2)_{16}—CH_3)$

22) $CH_3—(CH_2)_{20}—COO—CH_2—C(CH_2—O—CO—CH_3)(CH_2—O—CO—CH_3)(CH_2—O—CO—CH_3)$

Further, it is possible to use crystalline polyester for the crystalline substance; as regards the crystalline polyester, polyesters obtained by the reaction of diol belonging to aliphatic series and dicarboxylic acid belonging to aliphatic series (including acid anhydride or acid chloride) are desirable.

For the diol to be used for obtaining the crystalline polyester, ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane diol, 1,4-cyclohexane diol, 1,4-cyclohexane dimethanol, dipropylene glycol, polyethylene glycol, polypropylene glycol, polytetramethylene glycol, bisphenol A, bisphenol Z, hydrogen-added bisphenol A, etc. can be cited.

For the dicarboxylic acid to be used for obtaining the crystalline polyester, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecylsuccinic acid, isododecylsuccinic acid, isododecenylsuccinic acid, n-octylsuccinic acid, n-octenylsuccinic acid, acid anhydrides or acid chlorides of these, etc. can be cited.

For the polyester which is particularly desirable, polyester to be obtained by the reaction of 1,4-cyclohexanedimethnol and adipic acid, polyester to be obtained by the reaction of 1,6-hexane diol and sebacic acid, polyester to be obtained by the reaction of ethylene glycol and succinic acid, polyester to be obtained by the reaction of ethylene glycol and sebacic acid, and polyester to be obtained by the reaction of 1,4-butane diol and succinic acid can be cited; among these, the polyester obtained by the reaction of 1,4-cyclohexane dimethanol and adipic acid is most desirable.

The quantity of the above-mentioned compounds to be added is 1% to 30% by weight to the total weight of the toner, desirably 2% to 20% by weight, and more desirably 3% to 15% by weight.

(Developer)

A toner of this invention may be used as a mono-component developer or a two-component developer; in the case where it is used as a mono-component developer, a non-magnetic mono-component developer or a magnetic mono-component developer composed of toner particles containing magnetic particles having a particle diameter of 0.1 μm to 0.5 μm can be considered, and either of these can be used.

Further, it is possible to use the toner as mixed with carrier particles in a two-component developer; in this case, for the material of the magnetic particles of the carrier, materials heretofore known to the public such as metals such as iron, alloys of iron with metals such as aluminum and nickel, and metal oxides such as ferrite and magnetite can be used. Particularly, ferrite particles are desirable. The volume-average particle diameter of the above-mentioned magnetic particles is desirably 15 μm to 100 μm, and more desirably 25 μm to 80 μm.

As regards the measurement of the volume-average particle diameter of the carrier, representatively it can be measured by means of a laser diffraction type particle diameter distribution measuring apparatus equipped with a wet-type dispersion apparatus "HELOS" (manufactured by SYMPATEC Corp.).

For the carrier, one composed of magnetic particles covered with resin, or one of what is called a resin-dispersion type composed of resin particles having magnetic fine particles dispersed in the resin is desirable. For the resin composition to be used in coating, although it is not limited to a particular resin material, for example, olefine resin, styrene resin, styrene-acrylic resin, silicone resin, ester resin, or fluorocarbon resin, etc. can be used. Further, for the resin to compose a resin-dispersion type carrier, it is not particularly limited, and one known to the public can be used; for example, styrene-acrylic resin, polyester resin, fluorocarbon resin, phenol resin, etc. can be used.

EXAMPLES OF PRACTICE

In the following, for the purpose of explaining the structure and the effect of this invention, examples of the concrete mode of practice will be shown and explained; however, the mode of this invention is not to be limited to these.

Production of Resin Particles

[Resin Particles (1HML)]

(1) Production of Core Particles (First-stage Polymerization):

A surfactant solution (an aqueous medium) obtained by the dissolving of 1.08 g of the anion surfactant Compound (101) $C_{10}H_{21}(OCH_2CH_2)_2OSO_3Na$ in 3010 g of ion-exchange water was prepared in a separable flask having a capacity of 5000 ml equipped with a stirring device, a temperature sensor, a cooling tube, and a nitrogen introducing device, and while it was stirred at a stirring speed of 230 rpm under a nitrogen flow, the temperature inside the flask was raised to 80° C.

To this surfactant solution, a polymerization initiator solution having 9.2 g of a polymerization initiator (potassium persulfate: KPS) dissolved in 200 g of ion-exchange water was added, the temperature was raised to 75° C., then, a monomer mixture liquid composed of 70.1 g of styrene, 19.9 g of n-butylacrylate, 10.9 g of methacrylic acid was dropped gradually for one hour, and this system was heated and stirred at 75° C. for 2 hours to perform polymerization (first-stage polymerization); thus, resin particles (dispersion liquid of resin particles composed of high-molecular-weight resin) were prepared. This is to be referred to as "the resin particles (1H)".

(2) Formation of Intermediate Layers (Second-stage Polymerization):

In a flask having a stirring device attached, in a monomer mixture liquid composed of 105.6 g of styrene, 30.0 g of n-butylacrylate, 6.2 g of methacrylic acid, and 5.5 g of n-octyl-3-mercaptopropionic ester, 98.0 g of the compound expressed by the above-mentioned formula (19) (hereinafter referred to as "the exemplified compound (19)") was added as a crystalline substance, and was heated to 90° C. to be dissolved; thus, a monomer solution was prepared.

On the other hand, a surfactant solution composed of 1.6 g of a anion surfactant (the compound (101)) dissolved in 2700 ml of ion-exchange water was heated to 9820 C, and after the above-mentioned resin particles (1H) as a dispersion liquid of core particles of an amount of 28 g by conversion weight as a solid component was added to this surfactant solution, the monomer solution of the above-mentioned exemplified compound (19) was mixed and dispersed for 8 hours, by means of a mechanical dispersion apparatus having a circulating path (CLEARMIX, manufactured by M. TECHNIQUE Co., Ltd.); thus, a dispersion liquid (emulsion liquid) containing emulsified particles (oil drops) was prepared.

Subsequently, to this dispersion liquid (emulsion liquid), a polymerization initiator solution composed of 5.1 g of a polymerization initiator (KPS) dissolved in 240 ml of ion-exchange water and 750 ml of ion-exchange water were added, and polymerization (second-stage polymerization) was carried out through the heating and stirring of this system at 98° C. for 12 hours to give resin particles (dispersion liquid of complex resin particles having a structure such that the surface of resin particles composed of high-molecular-weight resin was covered with middle-molecular-weight resin). This sample is to be referred to as "the resin particles 1HM).

The above-mentioned resin particles (1HM) were dried, and when observed by means of a scanning type electron microscope, particles (400 nm to 1000 nm) containing the exemplified compound (19) as the main component and having not been enclosed by latex were recognized.

(3) Formation of Outer Layer

To the resin particles (1HM) obtained in the above-mentioned way, a polymerization initiator solution composed of 7.4 g of the polymerization initiator (KPS) dissolved in 200 ml of ion-exchange water was added, and under a temperature condition of 80° C., a monomer mixture liquid composed of 300 g of styrene, 95 g of n-butylacrylate, 15.3 g of methacrylic acid, and 10.4 g of n-octyl-3-mercaptopropionic ester was gradually dropped for 1 hour. After the completion of the dropping, after polymerization (third-stage polymerization) was carried out through the heating and stirring for 2 hours, the liquid was cooled to 28° C., and a dispersion liquid of resin particles (complex resin particles having a central part composed of high-molecular-weight resin, an intermediate layer composed of middle-molecular-weight resin, and an outer layer composed of low-molecular-weight resin) was obtained. This sample of resin particles is to be referred to as "the resin particles (1HML)".

The complex resin particles composing this resin particle sample (1HML) have peak molecular weight values at 138,000, 80,000, and 13,000, and the weight-average particle diameter of these complex resin particles was 122 nm.

[Resin Particles (2HML)]

Resin particles (dispersion liquid of resin particles having a central part composed of high-molecular-weight resin, an intermediate layer composed of middle-molecular-weight resin, and an outer layer composed of low-molecular-weight resin) were obtained in the same way as the resin particles (1HML) except for the use of 7.08 g of an anion surfactant (sodium dodecylbenzenesulfonate; SDS) instead of the surfactant (101). This resin particle sample is to be referred to as "the resin particles (2HML)".

The complex resin particles composing this resin particle sample (2HML) have peak molecular weight values at 138,000, 80,000, and 12,000, and the weight-average particle diameter of these complex resin particles was 122 nm.

[Resin Particles (3HML)]

Resin particles (dispersion liquid of resin particles having a central part composed of high-molecular-weight resin, an intermediate layer composed of middle-molecular-weight resin, and an outer layer composed of low-molecular-weight resin) were obtained in the same way as the resin particles (1HML) except for the use of 7.08 g of an anion surfactant (sodium dodecylbenzenesulfonate; SDS) instead of the surfactant (101). This resin particle sample is to be referred to as "the resin particles (3HML)".

The complex resin particles composing this resin particle sample (3HML) have peak molecular weight values at 138,000, 80,000, and 12,000, and the weight-average particle diameter of these complex resin particles was 110 nm.

Preparation of Wet Cake of Colored Particles 59.0 g of anion surfactant (sodium dodecylsulfate) was dissolved in 1600 ml of ion-exchange water by stirring, and while this solution was being stirred, 420.0 g of carbon black was slowly added; subsequently, through a dispersion processing using a "CLEARMIX" (manufactured by M. TECHNIQUE Co., Ltd.), dispersion liquid of coloring agent particles was prepared.

420.7 g (as converted into solid component) of resin particles (1HML), 900 g of ion-exchange water, and 166 g of coloring agent dispersion liquid was put in a reaction container (four-mouth flask) having a temperature sensor, a cooling tube, a nitrogen introducing device, and a stirring device attached and was stirred. After the temperature inside the container was adjusted to 30° C., sodium hydroxide solution having a concentration of 5 mol/l is added to adjust the pH to 8.

Subsequently, an aqueous solution having a coagulating agent as shown in the combination of Table 1 dissolved in 1000 ml of ion-exchange water was added while the liquid was stirred at 30° C. for 10 minutes.

TABLE 1

| | Coagulating agent | Stopping agent |
|---|---|---|
| Compound name | Magnesium chloride 6 hydrate | Sodium chloride |
| Addition quantity (g) | 12.1 | 80.4 |

After the liquid was left as it was for 3 minutes, the temperature raise was started; the temperature of this system was raised to 90° C. in 30 minutes, and then the growth of the particles was started. The particle diameter of the grown particles was measured by means of a "Coulter counter multisizer", and at the point of time when the volume-average particle diameter reaches 3 μm, a solution composed of a stopping agent as shown in the combination of Table 1 dissolved in 1000 ml of ion-exchange water was added to stop the growth of the particles. Further, by the heating and stirring at 98° C. for 2 hours as a ripening processing, the fusion bonding of the particles was continued.

After that, the liquid was cooled to 30° C., a solution containing hydrochloric acid was added to adjust the pH to 2.0, and the stirring was stopped; thus, slurry containing solid matter composed of particles having a volume-average diameter of 4.5 μm in an amount of 20% by weight was obtained.

Example of Practice 1

Production of Toner 1

(1) Concentration Process of Colored Particles

The above-mentioned slurry was introduced in a centrifugal precipitating apparatus of a disk type as shown in FIG. 1 having precipitating plates arranged at intervals of 0.5 mm and the total area of the precipitating plates of 500 times of the setup area of the apparatus, and the apparatus was operated with the number of revolutions set at 3000 rpm; thus, the concentration of the above-mentioned slurry was carried out. Besides, the centrifugal force in this case was 11000 G. As regards the slurry after concentration, 823 g of a wet cake having a solid component with a content ratio of 50% by weight was obtained. The obtained wet cake is to be referred to as "the wet cake 1". In addition, the time required for the concentration performed in this case was 0.4 second per 1 liter of the slurry.

(2) Re-dispersion and Re-concentration Process of Concentrated Slurry

The wet cake 1 was put in 10000 ml of ion-exchange water as a washing medium, and was dispersed by the use of stirring planes for 30 minutes to produce a dispersion liquid. The electrical conductivity of the dispersion liquid obtained was measured by means of an electrical conductivity meter "CM-14P" manufactured by TOA DENPA KOGYO K. K., and the slurry concentration and re-dispersion by means of the above-mentioned centrifugal precipitating apparatus of a disk type were repeated until the value of the electrical conductivity became 50 μS/cm or under.

(3) Final Adjustment Process

Toner particles are taken out from the wet cake 1 which came to have a conductivity of 50 μS/cm or under finally, and the state of the impurity particles attaching on the surface was observed for 100 toner particles by means of a transmission type electron microscope. As the result of the observation, it was confirmed that the number of toner particles having impurities attached on the surface in 100 toner particles was 1.

(4) Drying Process

After that, the toner particles were dried by a warm air flow at 40° C. until the water content got to 0.63%.

(5) External Addition Process

By the mixing of the dried colored particles with 1% by weight of fine hydrophobic silica particles, a toner was obtained. The obtained toner is to be referred to as "the toner 1".

Examples of Practice 2 TO 5

Production of the Toners 2 to 5

The toner 2 was obtained through the repeating of slurry concentration and re-dispersion in the same way except for the above-mentioned centrifugal precipitating apparatus of a disk type being made to have the precipitating plates arranged at intervals of 1.0 mm and have the total area of the precipitating plates equal to 200 times of the setup area of the apparatus. Besides, the processing time per 1 liter of the slurry at this time was 0.8 second.

In the same way, the toner obtained with the precipitating plates arranged at intervals of 0.25 mm, and the total area of the precipitating plates made to be 1000 times of the setup area of the apparatus was named as the toner 3, the toner obtained under the condition of 2.0 mm and 100 times is named as the toner 4, and the toner obtained under the condition of 10 mm and 10 times was named as the toner 5. The processing times of the toners 3, 4, and 5 per 1 liter of the slurry was 0.2 second, 1.5 seconds, and 3.5 seconds respectively. The number of toner particles having impurities in 100 toner particles for each of the toners is shown in Table 2.

Examples of Practice 6 AND 7

Production of Toners 6 and 7

The toner 6 was obtained in the same way as the example of practice 1 except for the ripening process not being carried out after the volume-average particle diameter reached 3 μm in the example of practice 1. Further, the toner 7 was obtained in the same way as the example of the practice 1 except for it that the ripening process was continued and the heating and stirring was prolonged at the liquid temperature 98° C. to continue the fusion bonding of the particles. The number of toner particles having impurities attached in 100 toner particles for each of the toners is shown in Table 2.

Examples of Practice 8 TO 13

Production of Toners 8 to 13

The toner 8 was obtained by the same procedure as the example of practice 1 except for it that the pH of the adjusting liquid used after the continuing of fusion bonding of the particles in the above-mentioned example of practice 1 was made to be 4.5. Further, the toner 9 was obtained by the pH of the adjusting liquid being made to be 6.5.

Further, toners which were obtained by the use of the adjusting liquids having the pH made to be 8, 10, 12, and 14 respectively were named as the toners 10, 11, 12, and 13. The number of toner particles having impurities attached in 100 toner particles for each of the toners obtained is shown in Table 2.

Example for Comparison 1

Toner for Comparison 1

The toner for comparison 1 was obtained in the same way as the example of practice 1 except for the omission of the processes (1) to (3). The number of toner particles having impurities attached in 100 toner particles for the toner obtained is shown in Table 2.

Example for Comparison 2

Toner for Comparison 2

The toner for comparison 2 was obtained through a process in which the slurry obtained was introduced into the tank of a centrifugal separator which was used instead of the centrifugal precipitating apparatus in the example of practice 1 and had a piece of filter cloth made of nonwoven fabric set, and slurry concentration was carried out by the operation of the centrifugal separator in the condition of an acceleration of 700 G. The number of toner particles having impurities attached in 100 toner particles for the toner obtained is shown in Table 2.

Example for Comparison 3

Toner for Comparison 3

The toner for comparison 3 was obtained through a process in which slurry concentration was carried out by the use of a decanter type centrifugal separator described in the publication of the unexamined patent application 2001-194826 instead of the centrifugal precipitating apparatus in the example of practice 1. The number of toner particles having impurities attached in 100 toner particles for the toner obtained is shown in Table 2.

The properties of the above-mentioned toners are shown in Table 2. Besides, in Table 2, the volume-average particle diameter values of the toner particles are those which were obtained by measurements using a COULTER COUNTER TA-II, and the number of toner particles having impurities attached in 100 toner particles was evaluated by the transmission type electron microscope photographs.

TABLE 2

| | Sedimentation plate | | | Slurry | | Toner | |
|---|---|---|---|---|---|---|---|
| | Plate interval (mm) | Total sedimentation area/setup area of condensation apparatus | Processing time per slurry 1 L (second) | pH | Particle concentration (%) | Volume-average particle diameter (μm) | Number of toner particles having impurities in 100 toner particles |
| *1 1 | 0.5 | 500 | 0.4 | 2 | 20 | 4.5 | 1 |
| *1 2 | 1.0 | 250 | 0.8 | 2 | 20 | 4.8 | 2 |
| *1 3 | 0.25 | 1000 | 0.2 | 2 | 40 | 4.7 | 0 |
| *1 4 | 2.0 | 100 | 1.5 | 2 | 40 | 4.3 | 1 |
| *1 5 | 10 | 10 | 3.5 | 2 | 8 | 5.2 | 4 |
| *1 6 | 0.5 | 500 | 0.4 | 2 | 20 | 3.0 | 2 |
| *1 7 | 0.5 | 500 | 0.4 | 2 | 20 | 7.2 | 2 |
| *1 8 | 0.5 | 500 | 0.4 | 4.5 | 20 | 5.0 | 2 |
| *1 9 | 0.5 | 500 | 0.4 | 6.5 | 20 | 4.5 | 0 |
| *1 10 | 0.5 | 500 | 0.4 | 8 | 20 | 4.4 | 1 |
| *1 11 | 0.5 | 500 | 0.4 | 10 | 20 | 4.9 | 2 |
| *1 12 | 0.5 | 500 | 0.4 | 12 | 20 | 5.0 | 2 |
| *1 13 | 0.5 | 500 | 0.4 | 14 | 20 | 4.6 | 1 |
| *2 1 | — | — | — | 2 | 20 | 6.8 | 70 |
| *2 2 | — | — | — | 2 | 20 | 7.2 | 40 |
| *2 3 | — | — | 120 | 2 | 20 | 7.1 | 50 |

*1; Example of practice
*2; Example for comparison

As clearly understood from the results shown in Table 2, it was confirmed that from the surface of the toner particles obtained by a production method according to this invention, impurities were removed.

Actual Copy Evaluation

For an image forming apparatus, a digital copying machine on the market SITIOS 7165 (manufactured by KONICA Corp.) was used. The above-mentioned digital copying machine was set at the following conditions for the practice of evaluation.

Charging Condition charging device: scorotron charger, initial charge potential at −750 V, Exposure Condition Exposure amount was set to make the potential of the exposed area −150 V, Development Condition DC bias voltage was set at −550 V, Transfer Condition Corona charging method.

Further, as regards the fixing apparatus, a heating roller having a surface roughness Ra of 0.8 μm composed of a metal core made of iron covered with a PFA (a copolymer of tetrafluoroethylene and perfluoroalkylvinyl ether) film having a thickness of 25 μm, and a pressing roller having a surface roughness Ra of 0.8 μm composed of a core made of HTV silicone rubber covered with a PFA tube having a thickness of 120 μm were used. Besides, the nip width was 3.8 mm, and the peripheral speed was 420 mm/s.

In addition, in the fixing apparatus, a cleaning mechanism and a silicone oil supplying mechanism was not provided. The fixing temperature was controlled on the basis of the surface temperature of the heating roller, which was set at 165° C.

For the developer, a silicone-coated carrier having a volume-average particle diameter of 60 μm was used, mixed with each of the toners so as to have a toner concentration of 6% by weight.

As regards the copying condition, one million sheets of copies were continuously printed in a high-temperature high-humidity condition (30° C., 83% RH), and for a copy image after one million sheet printing, the evaluation of the following items was practiced. In addition, for the copy image, a character original document of A4 size having a blackened area ratio of 5% was used, and printing of the same size as the original document were made on a transfer paper of A4 size.

(1) Change of Charge Quantity with the Passage of Time

With the charge quantity at the time the first image was outputted immediately after the developer was loaded denoted by Qa, and the charge quantity at the time the one millionth image was outputted denoted by Qb, the evaluation was made by the ratio Qb/Qa as follows:

A: Qb/Qa is not smaller than 0.9 and smaller than 1.1,

B: Qb/Qa is not smaller than 0.8 and smaller than 0.9, or not smaller than 1.1 and smaller than 1.2, C: Qb/Qa is not smaller than 0.7 and smaller than 0.8, or not smaller than 1.2 and smaller than 1.3

D: Qb/Qa is smaller than 0.7 or not smaller than 1.3.

(2) Toner Filming on the Photoreceptor Surface

By the visual observation of the photoreceptor surface immediately after the above-mentioned continuous one million sheet copying, the presence or absence of unevenness of density in halftone areas due to toner filming was judged.

A: A uniform image without unevenness is obtained, and no toner filming generation is observed;

B: Streak-shaped light unevenness is present, but it is of no problem practically, and no toner filming generation on the photoreceptor surface is recognized;

C: Streak-shaped light unevenness is present, and a little toner filming generation on the photoreceptor surface is recognized certainly, but it is of no problem practically;

D: Several or more clear streak-shaped uneven portions are present, and certain toner filming on the photoreceptor surface is recognized; there is practically a problem.

(3) Background Density

The relative density in white areas of the copy image after the continuous one million sheet copying to the density of an unused transfer paper sheet was measured by means of a Macbeth densitometer.

A: Relative density is equal to 0 or lower than 0.002,

B: Relative density is not lower than 0.002 and lower than 0.003,

C: Relative density is not lower than 0.003 and lower than 0.005,

D: Relative density is not lower than 0.005.

(4) Insufficient Cleaning

The cleaning performance was evaluated by the number of copies up to the beginning of the smudging in white areas due to the slipping-through of the toner particles in the cleaning unit.

(5) Halftone Dot Reproducibility

The halftone dot reproducibility in the first copy and that in the one millionth copy were evaluated by means of a MACBETH reflection densitometer "RD-918" for 10% halftone dot image area of 20 mm×20 mm. So long as the density change was smaller than 0.10, the change in image quality was evaluated as small and of no problem at all.

(6) Line Width

As regards the line width of a line image corresponding to an image signal of a two-dot line, the reproducibility was evaluated by means of a printed character evaluation system "RT 2000" (manufactured by YAAMAN Corp.). The evaluation was made for the line width and the change of line width of a line image in the first copy and the one millionth copy.

A: Line widths in the first and one millionth copies are both not greater than 200 μm, and the change of line width is equal to 0 or smaller than 5 μm;

B: Line widths in the first and one millionth copies are both not greater than 200 μm, and the change of line width is not smaller than 5 μm and smaller than 10 μm;

C: Line width of the first copy a little exceeds 200 μm, but line width of the one millionth copy is not greater than 200 μm, and the change of line width is smaller than 10 μm;

D: Line widths in the first and one millionth copies both exceed 200 μm, and the change of line width exceeds 10 μm.

(7) Loss of Structural Features in Characters

After one million sheet copying, images composed of 3 point characters and 5 point characters are formed, and the evaluation was made by the use of a loupe on the basis of the following judgement standard.

A: Both the 3 point and 5 point characters are clear and easily legible;

B: Illegible characters are partly generated for 3 point characters, but they are legible by the use of a loupe, and 5 point characters are clear and easily legible;

D: Almost all 3 point characters are illegible even by the use of a loupe, and a part or all of 5 point characters are visually illegible.

(7) Change in Gradation

At the start of copying and after the one million sheet copying, a halftone image having a reflection density of 0.3 is formed, and the density change was evaluated.

A: The density change between the initial and after one million sheet copying falls within a range of ±0.05;

B: The density change between the initial and after one million sheet copying falls within a range of ±0.1;

D: The density change between the initial and after one million sheet copying falls exceeds a range of ±0.1;

(In Another Way of Expression:)

A: The density value Dm after one million sheet copying corresponding to an initial density of 0.3 is expressed by the inequality $0.25 \leqq Dm \leqq 0.35$;

B: The density value Dm after one million sheet copying corresponding to an initial density of 0.3 is expressed by the inequality $0.20 \leqq Dm \leqq 0.40$;

C: The density value Dm after one million sheet copying corresponding to an initial density of 0.3 is expressed by the inequality $Dm<0.2$ or $Dm>0.4$;

The result of the above-mentioned evaluations are shown in Table 3.

TABLE 3

| | Change of charge quantity with passage of time | Toner filming on photo-receptor | Generation of background density | In-sufficient cleaning | Halftone dot repro-ducibility | Line width | Loss of structural features in characters | Change in grada-tion |
|---|---|---|---|---|---|---|---|---|
| *1 1 | A | A | A | *3 | 0.03 | A | A | A |
| *1 2 | A | A | A | *3 | 0.04 | B | B | B |
| *1 3 | B | A | A | *3 | 0.02 | A | A | A |
| *1 4 | A | A | A | *3 | 0.04 | B | A | A |
| *1 5 | A | B | B | *3 | 0.05 | B | B | B |
| *1 6 | A | A | A | *3 | 0.03 | A | A | A |
| *1 7 | A | A | A | *3 | 0.02 | A | A | A |
| *1 8 | A | A | A | *3 | 0.02 | A | A | A |
| *1 9 | A | A | A | *3 | 0.02 | A | A | A |
| *1 10 | A | B | A | *3 | 0.02 | A | A | A |
| *1 11 | A | B | A | *3 | 0.03 | A | A | A |
| *1 12 | B | B | B | *3 | 0.02 | A | A | A |
| *1 13 | B | B | B | *3 | 0.02 | A | A | B |
| *2 1 | D | D | D | *4 | 0.18 | D | D | D |
| *2 2 | C | C | B | *5 | 0.15 | C | C | C |
| *2 3 | D | D | D | *6 | 0.16 | D | D | D |

*1; Example of practice

*2; Example for comparison

*3; not observed up to one million sheets

*4; observed after 70,000 sheets

*5; observed after 120,000 sheets

*6; observed after 120,000 sheets

As clearly understood from the above-mentioned result of the evaluations, for the examples of practice 1 to 13, which were the toners produced by a toner production method according to this invention, even after the practice of continuous copying reaching one million sheets, the toners were very stable without the change in charging ability, and also in image formations in the above-mentioned environment, the generation of toner filming on the photoreceptor and insufficient cleaning were not observed. Further, even through the continuous copying of one million sheets, no background density was generated, and an image having an excellent halftone dot reproducibility and fine line reproducibility without the change in line width and loss of structural features in characters and a good halftone image quality was obtained.

It was confirmed that a toner obtained by a production method according to this invention was capable of exhibiting image quality performances such as fine line reproducibility and halftone image reproducibility to be required for a digital image forming apparatus even after a continuous copying process of one million sheets.

In addition, it was found that, by this invention, through the practicing of continuous copying processes of five million sheets, continuous copying process of ten million sheets further, and the above-mentioned evaluations made for both the experiments after these examples of practice had been carried out, a good result was obtained in both the experiments.

As obvious from the result of the examples of practice, in toner particles obtained through a process of slurry concentration by means of a centrifugal precipitating apparatus according to this invention, it was confirmed that impurity particles remaining on the surface of the toner particles were not observed at all, and it was confirmed that no change in charge quantity on the surface of the toner particles was observed even through a continuous copying process of one million sheets in a high-temperature high-humidity environment over a long period of time.

Further, in image formations using a toner according to this invention, it was confirmed that a stable toner image without change in image quality even through a long-term mass copying exceeding one million sheets in a high-temperature high-humidity environment could be obtained; thus, the establishment of a stable image formation technology to generate no change in charging ability has been accomplished.

What is claimed is:

1. A method of producing toner for developing an electrostatic latent image by a centrifugal concentrating device in which a centrifugal force is caused from a central region to a peripheral region and which comprises an inlet section to feed a slurry to the central region, a precipitating plate extending from the central region to the peripheral region and an accommodating section to accommodate a predetermined amount of a slurry at the peripheral region, the method comprising the steps of:

a feeding step of feeding a slurry containing toner particles, aqueous medium and impure fine particles having a specific gravity smaller than that of the toner particles to the inlet section;

an applying step of applying centrifugal force of 5000 G to 15000 G to the slurry with the centrifugal concentrating device having the precipitating plate with which the toner particles are precipitated from the slurry toward the peripheral region of the centrifugal concentrating device so that the precipitated toner particles are accumulated as a concentrated slurry in the accommodating section of the centrifugal concentrating device;

a delivering step of delivering impure fine particles and aqueous medium to the outside of the centrifugal concentrating device, and a discharging step of automatically discharging the concentrated slurry containing the accumulated toner particles from the accommodating section, wherein the number of toner particles holding free releasing agent particles attached to the surfaces of the toner particles is 3 or less per 100 discharged-toner particles.

2. The method of claim 1, wherein the pH of the slurry at the feeding step is 2 to 6.5.

3. The method of claim 1, wherein the pH of the slurry at the feeding step is 8 to 12.

4. The method of claim 1, wherein at the discharging step, the concentrated slurry containing the accumulated toner particles is discharged automatically from the accommodating section within a discharging time period which is not longer than 1 second per 1 liter of the concentrated slurry accommodated in the accommodating section.

5. The method of claim 1, further comprising:

a diluting step of diluting the discharged concentrated slurry containing the toner particles discharged from the accommodating section with aqueous medium to form a diluted slurry and a re-feeding step of re-feeding the diluted slurry and conducting the applying step, the delivering step and the discharging step for the diluted slurry so as to form a re-concentrated slurry.

6. The method of claim 1, wherein the slurry at the feeding step contains the toner particles in a concentration of 8 to 40% by weight.

* * * * *